US007201464B2

(12) United States Patent
Sekiya

(10) Patent No.: US 7,201,464 B2
(45) Date of Patent: Apr. 10, 2007

(54) INK-JET RECORDING APPARATUS AND COPYING MACHINE

(75) Inventor: Takuro Sekiya, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/224,656

(22) Filed: Aug. 20, 2002

(65) Prior Publication Data

US 2003/0058301 A1 Mar. 27, 2003

(30) Foreign Application Priority Data

Aug. 28, 2001 (JP) ..... 2001-257221
Oct. 3, 2001 (JP) ..... 2001-307144
Jul. 10, 2002 (JP) ..... 2002-201774

(51) Int. Cl.
*B41J 2/165* (2006.01)

(52) U.S. Cl. ..... 347/29; 347/30; 347/32

(58) Field of Classification Search ..... 347/22, 347/28, 29, 30, 32, 33
See application file for complete search history.

(56) References Cited

U.S. PATENT DOCUMENTS 4,157,992 A * 6/1979 Lundberg et al. ..... 524/322
5,040,000 A * 8/1991 Yokoi ..... 347/30
5,293,182 A 3/1994 Sekiya et al. ..... 347/62
5,389,962 A 2/1995 Sekiya et al. ..... 347/68
5,420,618 A 5/1995 Sekiya et al. ..... 347/9
5,504,508 A * 4/1996 Hashimoto ..... 347/24
5,530,463 A * 6/1996 Nystrom et al. ..... 347/44
5,534,897 A * 7/1996 Anderson et al. ..... 347/32
5,610,637 A 3/1997 Sekiya et al. ..... 347/10
5,657,060 A 8/1997 Sekiya et al. ..... 347/15
5,729,257 A 3/1998 Sekiya et al. ..... 347/9
5,754,202 A 5/1998 Sekiya et al. ..... 347/63
5,877,786 A 3/1999 Sekiya et al. ..... 347/15
5,883,645 A * 3/1999 Ikado et al. ..... 347/30
5,997,123 A * 12/1999 Takekoshi et al. ..... 347/14
6,039,425 A 3/2000 Sekiya et al. ..... 347/15
6,193,348 B1 2/2001 Sekiya et al. ..... 347/15
6,227,639 B1 5/2001 Sekiya et al. ..... 347/15

(Continued)

FOREIGN PATENT DOCUMENTS

EP 0 446 885 A1 * 9/1991

(Continued)

OTHER PUBLICATIONS

Pending U.S. Appl. No. 09/793,249, filed Feb. 26, 2001.

(Continued)

*Primary Examiner*—Shih-Wen Hsieh
(74) *Attorney, Agent, or Firm*—Cooper & Dunham LLP

(57) ABSTRACT

An ink-jet recording apparatus records information within a recording width on a recording surface of a recording medium, and is provided with a multi-nozzle ink-jet recording head which includes a nozzle surface and a plurality of nozzles arranged in an array on the nozzle surface to cover the recording width of the recording medium, a transport section which transports the recording medium to pass a position confronting the nozzle surface of the multi-nozzle ink-jet recording head, and a reliability maintaining mechanism which is provided to cover all of the nozzles of the multi-nozzle ink-jet recording head, so as to maintain reliability of the nozzles.

4 Claims, 27 Drawing Sheets

U.S. PATENT DOCUMENTS

| | | | | |
|---|---|---|---|---|
| 6,293,648 | B1 * | 9/2001 | Anderson | 347/29 |
| 6,338,545 | B1 | 1/2002 | Sekiya | 347/47 |
| 6,540,323 | B1 * | 4/2003 | Dowell et al. | 347/29 |
| 6,554,401 | B2 | 4/2003 | Sekiya | 347/47 |
| 6,565,186 | B1 * | 5/2003 | Hattori et al. | 347/24 |
| 6,568,778 | B1 | 5/2003 | Sekiya et al. | 347/9 |
| 6,598,959 | B2 | 7/2003 | Sekiya | 347/47 |
| 6,657,013 | B2 * | 12/2003 | Grootaert et al. | 525/326.3 |

FOREIGN PATENT DOCUMENTS

| | | | | |
|---|---|---|---|---|
| JP | 58-63450 | | 4/1983 | |
| JP | 361193857 | * | 8/1986 | 347/28 |
| JP | 2-179771 | | 7/1990 | |
| JP | 6-8461 | | 1/1994 | |
| JP | 6-71897 | | 3/1994 | |
| JP | 11-342621 | | 12/1999 | |
| JP | 2000-198210 | | 7/2000 | |
| JP | 2001-199075 | | 7/2001 | |

OTHER PUBLICATIONS

Pending U.S. Appl. No. 09/988,845, filed Nov. 19, 2001.
Pending U.S. Appl. No. 08/547,904, filed Oct. 25, 1995.
Pending U.S. Appl. No. 10/085,204, filed Feb. 26, 2002.

* cited by examiner

INK-JET RECORDING APPARATUS AND COPYING MACHINE

BACKGROUND OF THE INVENTION

This application claims the benefit of Japanese Patent Applications No. 2001-257221 filed Aug. 28, 2001, No. 2001-307144 filed Oct. 3, 2001 and No. 2002-201774 filed Jul. 10, 2002, in the Japanese Patent Office, the disclosures of which are hereby incorporated by reference.

1. Field of the Invention

The present invention generally relates to ink-jet recording apparatuses and copying machines, and more particularly to an ink-jet recording apparatus which has ink-jet nozzles arranged to cover the entire width of a recording medium and is provided with a reliability maintaining mechanism, and to a copying machine which uses such an ink-jet recording apparatus.

2. Description of the Related Art

An ink-jet recording apparatus carries out a recording operation by ejecting and adhering ink on a recording surface of a recording medium such as paper. Such an ink-jet recording apparatus is popularly used. Generally, the ink-jet recording apparatus is provided with a recording head having an ink-jet nozzle forming surface for ejecting the ink with respect to the recording surface of the recording medium.

For example, the recording head ejects ink drops by a pressure of an electro-mechanical converter or, by a heating energy of an electro-thermal converter, which is controlled based on a driving control signal supplied to the recording head depending on the image data. The ink is ejected with respect to the recording surface of the recording medium via the ink-jet nozzle forming surface of the recording head. In order to increase the recording speed, a plurality of ink-jet nozzles are arranged at the ink-jet nozzle forming surface of the recording head, that is, a multi-nozzle recording head. For example, the ink-jet nozzles are arranged at a relatively high density of 400 dpi to 600 dpi or, arranged to cover the entire recording region on the recording medium, such as the entire width of the recording medium.

In the multi-nozzle recording head of the latter type, the number of ink-jet nozzles (or orifices) is extremely large and is on the order of several thousand to several ten thousand. Hence, the probability of a nozzle clogging for such a multi-nozzle recording head is considerably large compared to that of a recording head only having several tens of ink-jet nozzles. However, the development of countermeasures against the nozzle clogging caused by the considerably increase in the number of ink-jet nozzles has recently just started, and no definite and effective means have yet been proposed. In addition, when the multi-nozzle recording head of the latter type having the extremely large number of ink-jet nozzles is applied to color recording, the number of such multi-nozzle recording heads used will increase, but countermeasures against the nozzle clogging in a plurality of multi-nozzle recording heads when carrying out the color recording have yet to be proposed.

SUMMARY OF THE INVENTION

Accordingly, it is a general object of the present invention to provide a novel and useful ink-jet recording apparatus and copying machine, in which the problems described above are eliminated.

Another and more specific object of the present invention is to provide an ink-jet recording apparatus and a copying machine, which can effectively prevent clogging of nozzles and guarantee a high reliability for a long period of time, using a relatively simple structure, even with respect to a multi-nozzle ink-jet recording head having an extremely large number of nozzles which are arranged to cover the entire recording width of a recording medium on which the recording is to be made.

Still another object of the present invention is to provide an ink-jet recording apparatus which records information within a recording width on a recording surface of a recording medium, comprising a multi-nozzle ink-jet recording head which includes a nozzle surface and a plurality of nozzles arranged in an array on the nozzle surface to cover the recording width of the recording medium; a transport section which transports the recording medium to pass a position confronting the nozzle surface of the multi-nozzle ink-jet recording head; and a reliability maintaining mechanism which is provided to cover all of the nozzles of the multi-nozzle ink-jet recording head, so as to maintain reliability of the nozzles. According to the ink-jet recording apparatus of the present invention, it is possible to effectively prevent clogging of the nozzles and guarantee a high reliability for a long period of time, using a relatively simple structure.

A further object of the present invention is to provide an ink-jet recording apparatus which records information within a recording width on a recording surface of a recording medium, comprising a recording section having a plurality of multi-nozzle ink-jet recording heads, each of the multi-nozzle ink-jet recording heads including a nozzle surface and a plurality of nozzles arranged in an array on the nozzle surface to cover the recording width of the recording medium; a transport section which transports the recording medium to pass a position confronting the nozzle surface of each of the multi-nozzle ink-jet recording heads of the recording section; and a reliability maintaining mechanism which is provided to cover all of the nozzles of each of the multi-nozzle ink-jet recording heads, so as to maintain reliability of the nozzles. According to the ink-jet recording apparatus of the present invention, it is possible to effectively prevent clogging of the nozzles and guarantee a high reliability for a long period of time, using a relatively simple structure.

Another object of the present invention is to provide a copying machine comprising a scanner section which scans and reads a document image and outputs image data indicating the read document image; a transport section which transports a recording medium; and a recording section which records the read image onto a recording surface of the recording medium which is transported by the transport section within a recording width based on the image data, where the recording section comprises a multi-nozzle ink-jet recording head which includes a nozzle surface and a plurality of nozzles arranged in an array on the nozzle surface to cover the recording width of the recording medium; a reliability maintaining mechanism which is provided to cover all of the nozzles of the multi-nozzle ink-jet recording head, so as to maintain reliability of the nozzles, and the transport section transports the recording medium to pass a position confronting the nozzle surface of the multi-nozzle ink-jet recording head of the recording section. According to the copying machine of the present invention, it is possible to effectively prevent clogging of the nozzles and guarantee a high reliability for a long period of time, using a relatively simple structure.

Still another object of the present invention is to provide a copying machine comprising a scanner section which scans and reads a document image and outputs image data indicating the read document image; a transport section which transports a recording medium; and a recording section which records the read image onto a recording surface of the recording medium which is transported by the transport section within a recording width based on the image data, where the recording section comprises a plurality of multi-nozzle ink-jet recording heads, each of the multi-nozzle ink-jet recording heads including a nozzle surface and a plurality of nozzles arranged in an array on the nozzle surface to cover the recording width of the recording medium; and a reliability maintaining mechanism which is provided to cover all of the nozzles of each of the multi-nozzle ink-jet recording heads, so as to maintain reliability of the nozzles, and the transport section transports the recording medium to pass a position confronting the nozzle surface of each of the multi-nozzle ink-jet recording heads of the recording section. According to the copying machine according to the present invention, it is possible to effectively prevent clogging of the nozzles and guarantee a high reliability for a long period of time, using a relatively simple structure.

Other objects and further objects of the present invention will be apparent from the following detailed description when read in conjunction with the accompanying drawings.

DESCRIPTION OF THE PREFERRED EMBODIMENTS

Figure 1:
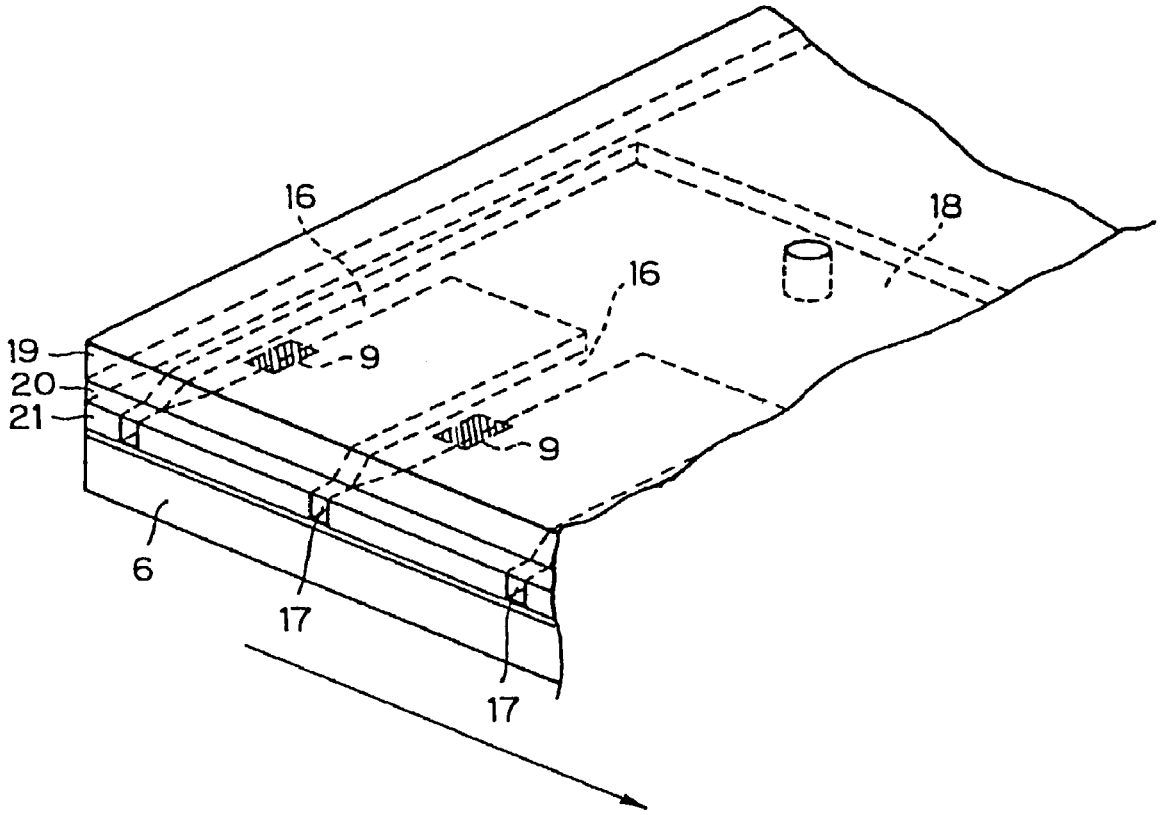
FIG. 1 is a perspective view showing a portion of a multi-nozzle ink-jet recording head used in an embodiment of an ink-jet recording apparatus according to the present invention.

FIG. 1 is a perspective view showing a portion of a multi-nozzle ink-jet recording head used in an embodiment of an ink-jet recording apparatus according to the present invention. In this embodiment, the multi-nozzle ink-jet recording head is formed by a thermal ink-jet recording head which has a structure that can easily realize a high-density array of ink-jet nozzles such as 400 dpi to 2400 dpi. However, the multi-nozzle ink-jet recording head is of course not limited to such a structure.

The ink-jet recording head shown in FIG. 1 includes a flow passage 16, nozzles 17, a common ink chamber 18, a top late 19, a bonding layer 20, and a flow passage barrier 21. Only 3 nozzles 17 are shown in FIG. 1, but actually, an extremely large number of nozzles 17 are provided to cover the recording width of a recording medium such as paper, as will be described later. For example, several thousand to several ten thousand nozzles 17 are arranged in a direction of an arrow in FIG. 1, that is, in the direction along the recording width of the recording medium.

Figure 2A:
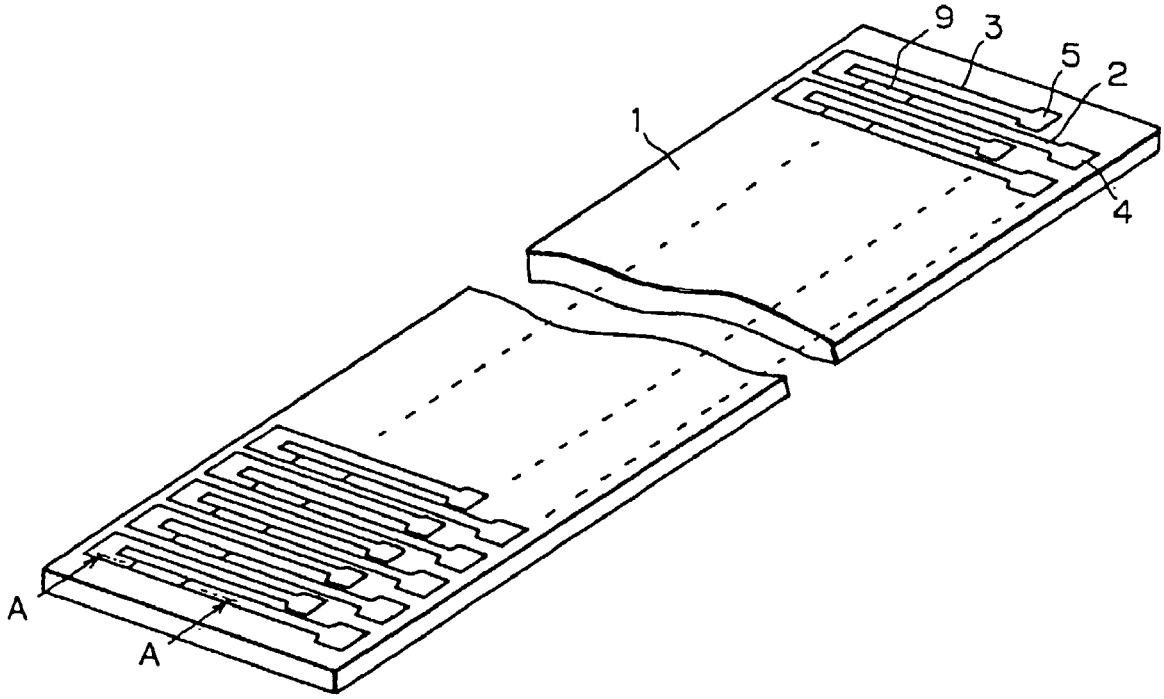
FIGS. 2A and 2B respectively are a perspective view and a cross sectional view showing a heater element substrate structure of the recording head shown in FIG. 1.
Figure 2B:
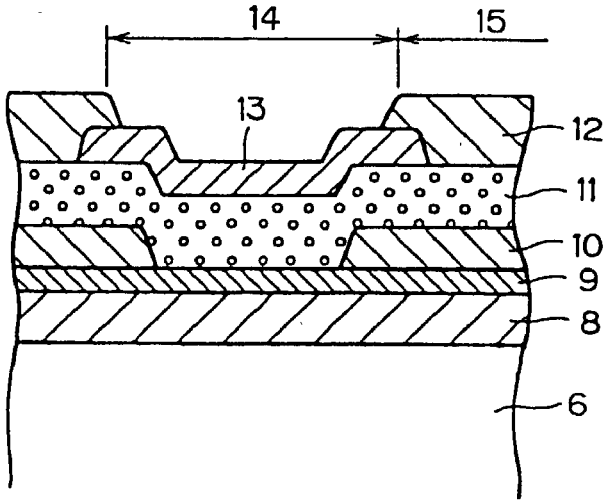

FIGS. 2A and 2B respectively are a perspective view and a cross sectional view showing a heater element substrate structure of the ink-jet recording head shown in FIG. 1. FIG. 2B shows the cross section taken along a line A—A in FIG. 2A. A heater element substrate structure 1 shown in FIGS. 2A and 2B includes first electrodes (control electrodes) 2, second electrodes (ground electrodes) 3, bonding pads 4 and 5, a substrate 6, a head accumulating layer 8, heater elements 9, electrodes 10, a protection layer 11, an electrode protection layer 12, a protection layer 13, a heater element part 14, and an electrode part 15. For example, the heat accumulating layer 8 is made of $SiO_2$, the heater elements 9 are made of $HfB_2$, the electrodes 10 are made of Al, the protection layer 11 is made of $SiO_2$, and the electrode protection layer 12 is made of a resin. For the sake of convenience, FIG. 2A only shows the heater elements 9 and the electrodes 2 and 3 which are particularly important in this embodiment.

The heater element substrate structure 1 is formed by employing thin film forming techniques such as sputtering and pattern forming techniques such as photo-etching, to form and pattern layers on the substrate 6 which is made of a ceramic such as alumina, glass or Si. The $SiO_2$ heat accumulating layer 8, the $HfB_2$ heater elements 9, the electrodes 10, the $SiO_2$ protection layer 11, the electrode protection layer 12, and the protection layer 13 are successively formed on the substrate 6, and the heater element part 14 and the electrode part 15 are formed on a surface portion of the heater element substrate structure 1, as shown in FIG. 2B. As shown in FIG. 2A, each heater element 9 is connected to the first electrode (control electrode) 2 and the second electrode (ground electrode) 3. The bonding pad 4 is provided at the end of the first electrode 2, and the bonding pad 5 is provided at the end of the second electrode 3. The bonding pads 4 and 5 are connected to an external image information input means (not shown), and each heater element 9 can be driven independently. The second electrodes 3 may be provided as a single common second electrode with respect to a plurality of heater elements 9, that is, with respect to a plurality of first electrodes 2. Instead of driving each of the heater elements 9 independently as in the case shown in FIGS. 2A and 2B, it is possible to drive the heater elements using a matrix driving scheme. The heater elements 9 are arranged in an array with a density of 400 dpi to 2400 dpi, for example. In other words, several thousand to several ten thousand heater elements 9 are provided depending on the required recording width of the recording medium.

The heat accumulating layer 8 is formed on the substrate 6. This heat accumulating layer 8 is provided to prevent the heat generated from the heater element 9 from escaping towards the substrate 6. In other words, the heat generated from the heater element 9 is efficiently transferred to the ink by the provision of the heat accumulating layer 8, so that stable air bubbles are generated within the ink. Normally, $SiO_2$ is used for the heat accumulating layer 8. When forming the heat accumulating layer 8, the $SiO_2$ may be formed to a thickness of 1 μm to 5 μm by a thin film forming technique such as sputtering.

As shown in FIG. 2B, the heater element 9, that is, a layer forming the heater element 9, is formed on the $SiO_2$ heat accumulating layer 8. For example, the heater element 9 may be made of a material selected from a mixture of tantalum (Ta)—$SiO_2$, tantalum nitride, nichrome, silver-palladium alloy, silicon semiconductor, and borides of metals such as hafnium, lanthanum, zirconium, titanium, tantalum, tungsten, molybdenum, niobium, chromium and vanadium. The metal boride is preferably hafnium boride ($HfB_2$), zirconium boride, lanthanum boride, tantalum boride, vanadium boride and niobium boride in this order of preference.

The heater element 9 may be formed by the thin film forming technique such as electron beam evaporation and sputtering. The thickness of the heater element 9 is set so that a desired amount of heat is generated per unit time, depending on the area, material, shape and size of the heat acting portion, the actual power consumption and the like. Normally, the thickness of the heater element 9 is 0.001 μm to 5 μm. and preferably 0.01 μm to 1 μm. In this embodiment, HfB2 is formed to a thickness of 0.2 μm by sputtering, so as to form the heater element 9.

The electrode 10 may be made of any suitable electrode material, such as Al, Ag, Au, Pt and Cu. The electrode material is formed at a predetermined position to predetermined size, shape and thickness, by the thin film forming technique such as evaporation. In this embodiment, Al is sputtered to a thickness of 1.4 μm so as to form the electrode 10.

The characteristics required of the protection layer 11 include anti-corrosion with respect to the ink, and resistance with respect to shock caused by disappearance of the air bubbles. The latter is sometimes referred to as anti-cavitation corrosion. Another characteristic required of the protection layer 11 is to effectively transfer the heat generated from the heater element 9 to the heat-sensitive paper, ink ribbon or recording liquid, namely, the ink.

For example, the protection layer 11 may be made of a material selected from silicon oxide, silicon nitride, magnesium oxide, aluminum oxide, tantalum oxide and zirconium oxide. The protection layer 11 may be formed by the thin film forming technique such as electron beam evaporation and sputtering. In addition, the protection layer 11 may also be made of a ceramic material such as silicon carbide and aluminum oxide (alumina).

Normally, the thickness of the protection layer 11 is 0.01 μm to 10 μm, and preferably 0.1 μm to 5 μm, and most preferably 0.1 μm to 3 μm. In this embodiment, $SiO_2$ is sputtered to a thickness of 1.2 μm to form the protection layer 11.

The electrode protection layer 12 and the protection layer 13 are provided in FIG. 2B. The electrode protection layer 12 is formed by forming a resin layer to a thickness of 2 μm. However, the electrode protection layer 12 is not essential and may be omitted. The protection layer 13 is preferably made of tantalum (Ta), by taking into consideration the anti-cavitation corrosion. Since the cavitation shock is applied to the region of the heater element 9 due to the generation of air bubbles, Ta is sputtered to a thickness of 0.4 μm, for example, so as to form the protection layer 13 which protects the heater element region from damage, thereby guaranteeing a satisfactory performance of the ink-jet recording head.

The ink-jet recording head is formed by using the heater element substrate structure 1 having the structure described above. More particularly, the ink-jet recording head is produced by the process described hereinafter with reference to FIGS. 3A through 3F. FIGS. 3A through 3F are cross sectional views for explaining the process of producing the ink-jet recording head. In FIGS. 3A through 3F, reference numerals 19, 20, 21, 22 and 23 respectively denote the top plate, the bonding layer, the flow passage barrier, a photoresist and a photomask.

Figure 3A:
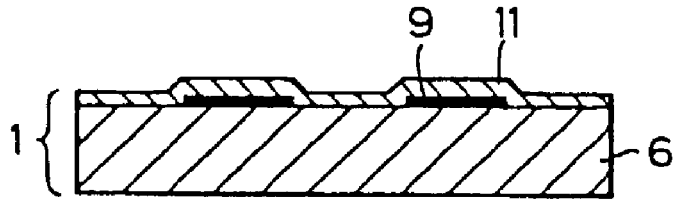
FIGS. 3A through 3F are cross sectional views for explaining a process of producing the recording head.

The heater element substrate structure 1 is prepared, as shown in FIG. 3A. The heater element substrate structure 1 has the heater element 9 formed on the substrate 6, and the protection layer 11 for protecting and insulating the heater element 9.

Figure 3B:
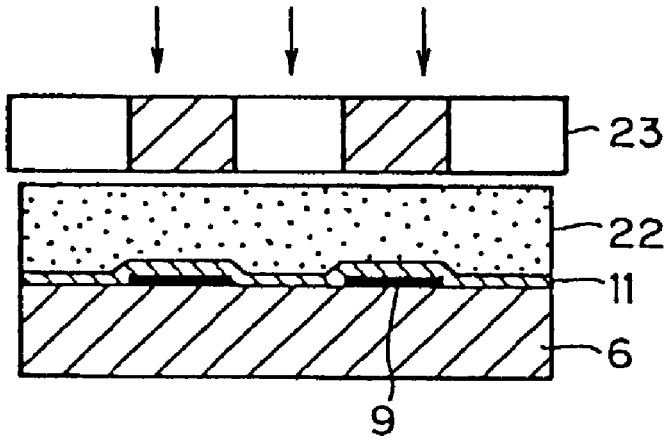

The photoresist 22 is coated on the heater element substrate structure 1, as shown in FIG. 3B. For example, the photoresist 22 having a viscosity of 1000 cP to 2000 cP is coated on the heater element substrate structure 1 shown in FIG. 3A to a thickness of approximately 5 μm to 30 μm by spin-coating, dip-coating or roller-coating. The thickness of the photoresist 22 determines the final height of the flow passage barrier 21, and this height varies depending on the density of the array of the heater elements 9, that is, the recording density. When it is desirable for the photoresist 22 to have a thickness of 20 μm or greater, a dry film type photoresist may be used in place of a liquid photoresist. Then, as shown in FIG. 3B, the photo-mask 23 having a predetermined pattern is overlapped on the photoresist 22 which is provided on the surface of the heater element substrate structure 1, and an exposure is made from above the photo-mask 23. In this state, the positions where the heater elements 9 are to be provided and the pattern of the photo-mask 23 should be positionally aligned.

Figure 3C:
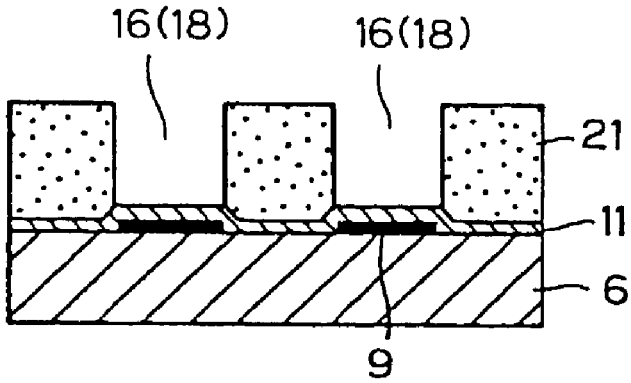

Next, the flow passage barrier 21 is formed as shown in FIG. 3C. The photoresist 22 and the unexposed portions of the exposed photoresist 22 are removed by an alkaline developer such as sodium carbonate solution, so as to form the flow passage barrier 21. Each portion of the photoresist 22 where the photoresist 22 is removed becomes a recess having the heater element 9, and the flow passage 16 and the common ink chamber 18 are formed.

Figure 3D:
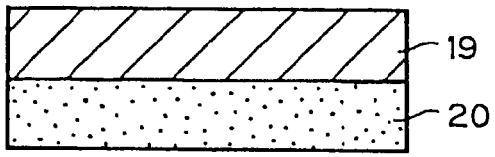

A substrate which forms a ceiling with respect to the flow passage 16 and the common ink chamber 18 is formed as shown in FIG. 3D. This substrate is obtained by bonding a bonding layer 20 and a glass substrate 19. The glass substrate 19 forms the top plate.

Figure 3E:
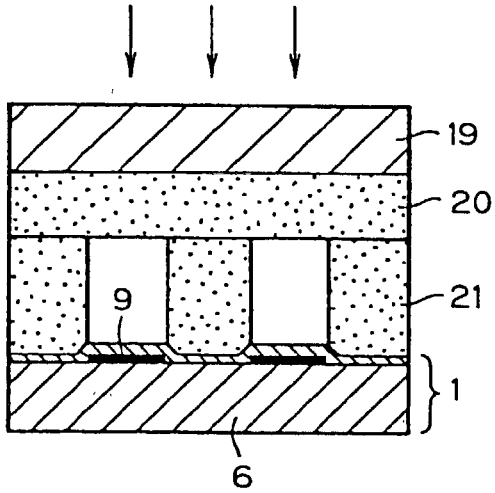

The substrate is bonded to the flow passage barrier 21 as shown in FIG. 3E. The heater element substrate structure 1 and the glass plate 19 which becomes the top plate are bonded so that the flow passage barrier 21 (photoresist 22) and the bonding layer 20 confront each other. In this state, a thermosetting process at a temperature of 150 to 250 for 30 minutes to 60 minutes or, an ultraviolet irradiation process at an ultraviolet intensity of 50 $mW/cm^2$ to 200 $mW/cm^2$ or greater is carried out, so as to improve the resistance against the ink and the bonding strength.

Figure 3F:
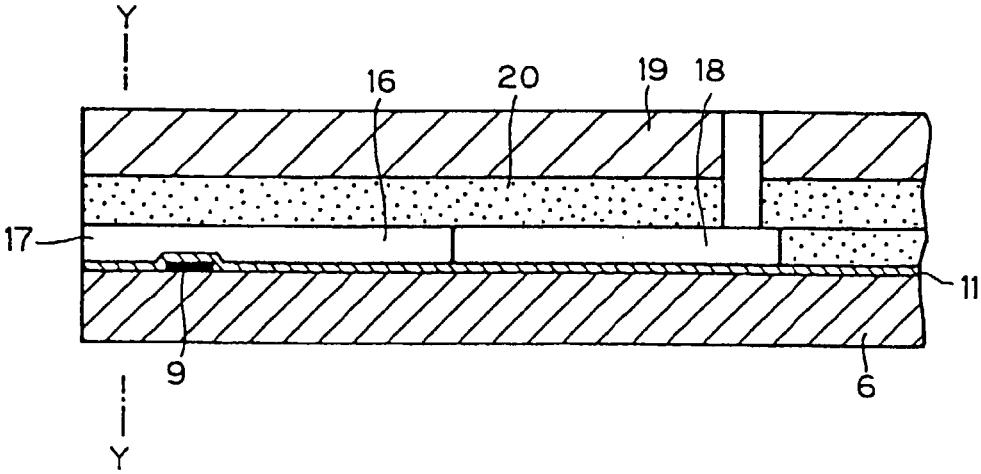
Figure 4A:
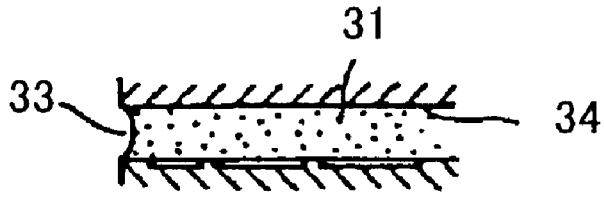
FIGS. 4A through 4G are diagrams for explaining an operation of the recording head.
Figure 4B:
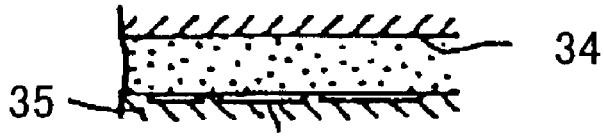
Figure 4C:
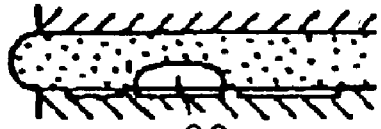
Figure 4D:
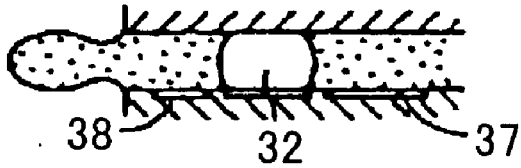
Figure 4E:
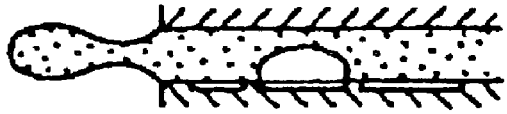
Figure 4F:
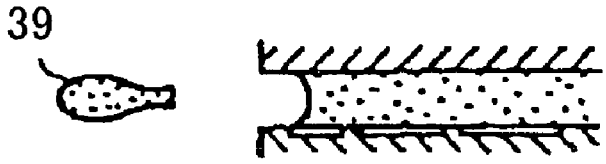
Figure 4G:
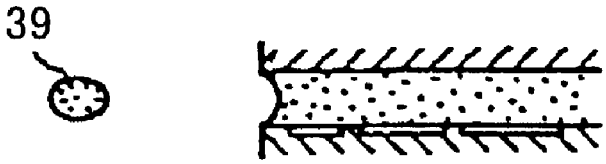

Finally, ink-jet nozzle 17 is formed as shown in FIG. 3F. A portion in a vicinity of the opening on the side of the heater element 9 is cut along a line Y—Y in FIG. 3F by dicing, so as to form the ink-jet nozzle 17, to thereby complete the ink-jet recording head.

It is also possible to employ a method of forming the ink-jet nozzle 17, which arranges a resin film at the tip end portion of the flow passage 16 and forms the ink-jet nozzle by an excimer laser, for example. The excimer laser can form the ink-jet nozzle 17 to have an arbitrary shape depending on the mask shape. Hence, the ink-jet nozzle 17 can be made to have a circular shape, polygonal shape, or a radial shape such as a star shape, by taking into consideration the relationship between the shape of the ink-jet nozzle 17 and the ink-jet characteristic. For example, the resin film used in this case may be selected from resins such as polysulfon, polyether sulfon, polyphenylene oxide, polypropylene and polyimide.

Next, a description will be given of the operating principle of the ink-jet of the ink-jet recording head having the above described structure, by referring to FIGS. 4A through 4G. FIGS. 4A through 4G are diagrams for explaining the operation of the ink-jet recording head.

FIGS. 4A through 4G show an ink 31, an air bubble 32, a nozzle 33, a flow passage 34, a heater element substrate structure 35, a heater element 36, a first electrode (control electrode) 37, a second electrode (ground electrode) 38, and an ink drop 39. A signal pulse is input to the heater element 36 via the first and second electrodes 37 and 38, depending on the image information to be recorded. The air bubble 32 is generated within the ink 31 depending on the input signal pulse. By the force of the air bubble 32, a portion of the ink 31 in the flow passage 34 is ejected from the nozzle 33 as the ink drop 39. The ejected ink drop 39 is recorded on the recording medium such as paper.

The duration of the signal pulse input to the heater element 36 is desirably several μs to ten odd μs, and is 30 μm at the maximum. This is because, once the air bubble 32 is generated above the heater element 36, the air bubble 32 blocks the heat from the heater element 36, and the size of the air bubble 32 remains substantially unchanged. Even if the signal pulse is input to the heater element 36 for an unnecessarily long time, the power is wasted, and further, the heater element 36 may become damaged. When the signal pulse is no longer input to the heater element 36, the heat of the air bubble 32 is absorbed by the heater element substrate structure 35 and the surrounding ink 31, and the air bubble 32 contracts and disappears. As may be readily understood from the above description, the air bubble 32 which is used for the ink-jet in this embodiment is obtained by rapid heating which occurs within an extremely short period of time, and the phenomenon is sometimes referred to as film ebullition in the field of heat transfer. Hence, the reproducibility of the generation and disappearance of the air bubble 32 is extremely fine.

As another method of realizing the ink-jet, the heater element 36 shown in FIGS. 4A through 4G may be located closer to the nozzle 33 so as to eject a smaller ink drop or, to make the air bubble 32 extend outside the nozzle 33 or burst at the nozzle 33.

Of course, the present invention is not limited to the thermal ink-jet recording head, and the present invention may similarly be applied to the ink-jet recording heads which use piezoelectric elements or the like for ejecting the ink.

Figure 5:
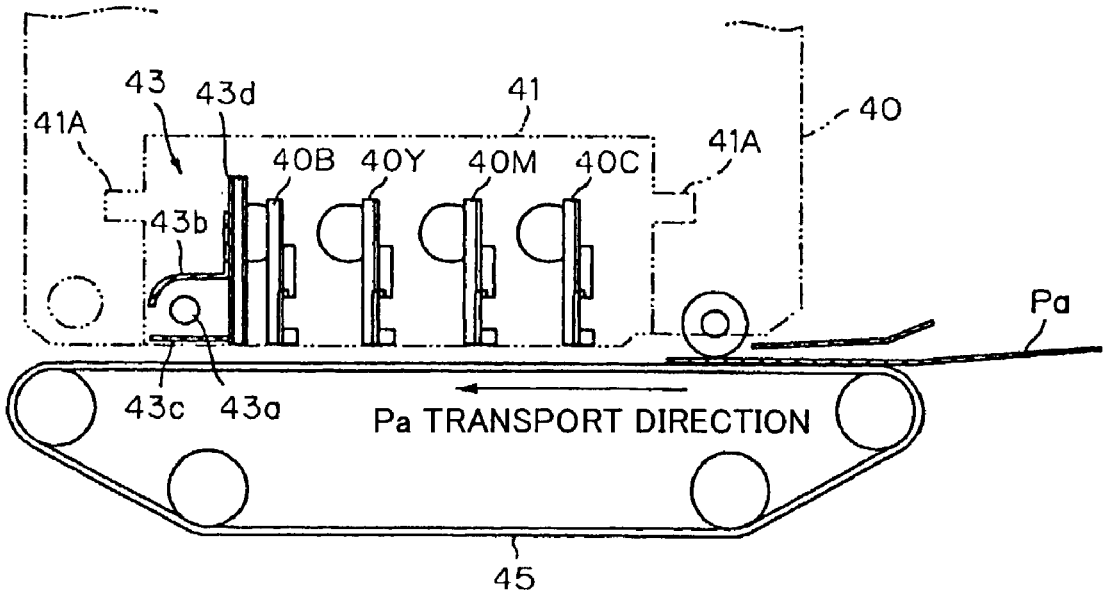
FIG. 5 is a diagram showing a recording section of the embodiment of the ink-jet recording apparatus.

FIG. 5 is a diagram showing a recording section 40 of the embodiment of the ink-jet recording apparatus, together with a medium transport section 45. The recording section 40 includes a head block 41. This head block 41 has multi-nozzle recording heads 40C, 40M, 40Y and 40B, and a thermal fixing unit 43 which will be described later. Each of the recording heads 40C, 40M, 40Y and 40B has a plurality of ink-jet nozzles covering the entire recording width of a recording medium Pa. The head block 41 is supported within the recording section 40 via projections 41A which are provided at both sides along a transport path of the recording medium Pa. The recording medium Pa is transported in the transport path in a direction indicated by an arrow by the medium transport section 45.

The recording heads 40C, 40M, 40Y and 40B are successively arranged at predetermined intervals from the upstream side towards the downstream side of the transport path of the recording medium Pa. The recording heads 40C, 40M, 40Y and 40B are positioned and fixed within the head block 41 so that the ink-jet nozzle forming surfaces of the recording heads 40C, 40M, 40Y and 40B are located on the same plane with an error within approximately several tens of μm.

It is assumed for the sake of convenience that the recording heads 40C, 40M, 40Y and 40B are thermal ink-jet recording heads which respectively eject cyan (C) ink, magenta (M) ink, yellow (Y) ink and black (B) ink. In each of the recording heads 40C, 40M, 40Y and 40B, the plurality of ink-jet nozzles are arranged in a direction approximately perpendicular to the transport direction of the recording medium Pa, and for example, the ink-jet nozzles are provided for the entire width of the recording surface of the recording medium Pa, where the width of the recording surface of the recording medium Pa is approximately perpendicular to the transport direction of the recording medium Pa. A heater element which functions as an electrothermal converter is provided in the flow passage which communicates to the corresponding ink-jet nozzle, and the ink is ejected from the ink-jet nozzle when the heater element heats the ink.

Each of the recording heads 40C, 40M, 40Y and 40B carries out a recording operation with respect to the same recording medium Pa. For example, the recording head 40C records first, the recording head 40M records second, the recording head 40Y records third, and the recording head 40B records fourth. As a result, cyan, magenta, yellow and black images are recorded in an overlapping manner on the recording surface of the recording medium Pa to form a full-color image. For example, at least one of the recording heads 40C, 40M, 40Y and 40B may eject a processing fluid which makes the ink insoluble. Alternatively, prior to the ink-ejection, at least one of the recording heads 40C, 40M, 40Y and 40B may eject a processing fluid which prevents unnecessary spreading or running of the ink pixels on the recording medium Pa.

According to the ink-jet recording, the ink ejected onto the recording medium Pa permeates into the recording medium and the ink becomes fixed with respect to the recording medium Pa. Alternatively, the ink ejected onto the recording medium Pa is fixed on the recording medium Pa due to an evaporation process of a solvent included in the ink.

However, a time it takes for the ink adhered onto the recording medium Pa to become fixed on the recording medium Pa, that is, the fixing speed, is not only greatly dependent upon the structure and composition or properties of the recording medium Pa, but is also greatly dependent upon the external ambient state. In addition, the natural fixing speed cannot be increased beyond a certain speed due to the physical characteristics.

The speed at which the ink adhered on the recording medium Pa permeates into the recording medium Pa also greatly depends upon the composition of the ink used.

Normally, the composition of the ink is often categorized depending on the permeability of the ink with respect to the recording medium. In general, the ink having a high permeability is advantageous from the point of view of the fixing characteristic, because the permeation speed of the ink with respect to the recording medium is high. However, the ink having the high permeability is disadvantageous from the point of view of the image quality, because the ink having the high permeability with respect to the recording medium will spread or run and cause deterioration of the image quality. Furthermore, because the ink permeates into a deep portion of the recording medium, the image tone is also likely to deteriorate.

On the other hand, when the ink having a low permeability is used, it takes time for the ink to permeate into the recording medium. From the point of view of the fixing characteristic, mixing or running of the ink may occur among the color inks and the image may be rubbed when ejecting the recorded recording medium in the case of the multi-color recording, particularly in the case of this embodiment where the multi-nozzle ink-jet recording head which covers the entire recording width of the recording medium is used to realize a high-speed recording. The image quality greatly deteriorates if the image is rubbed when ejecting the recording medium before the image is completely fixed.

Accordingly, the ink-jet recording apparatus must be constructed to avoid the above described problems related to the fixing characteristic, image tone, the spreading or running of the ink, and the image quality deterioration caused by rubbing of the image before fixing.

In conventional serial scan-type recording apparatuses, the fixing characteristic can be guaranteed to a certain extent by use of a relatively simple structure, because of the relatively slow recording speed.

However, in the case of the high-speed recording and color recording as in this embodiment, it is necessary to increase the fixing speed and to efficiently carry out the fixing, so that the ink adhered onto the recording medium is fixed to a desired state within a short time. The thermal fixing unit 43 is provided for this purpose. The thermal fixing unit 43 covers the entire width of the recording surface of the recording medium Pa, and desirably covers a range (or width) larger than the width of the recording surface of the recording medium Pa.

For example, the thermal fixing unit 43 is located on a downstream side of the recording head 40B in the transport path, at a position relatively close to the recording head 40B as shown in FIG. 5. The thermal fixing unit 43 includes a halogen heater 43*a* which is provided as a heater element, a reflection plate 43*b* for reflecting the heat ray from the halogen heater 43, a heater blocking member 43*c* for partitioning the halogen heater 43*a* and the transport path, and a heat insulator unit 43*d* for preventing heat transfer from the halogen heater 43*a* to the recording head 40B. Of course, the construction of the thermal fixing unit 43 is not limited to that shown in FIG. 5, and for example, it is possible to use a ceramic heater to carry out the fixing.

In this embodiment, the recorded image on the recording medium Pa is fixed by non-contact heating. As a result, the volatile component such as water within the ink can be efficiently dried by the heating of the surface of the recording medium Pa without making contact with the surface of the recording medium Pa.

In the above described embodiment, the heating (or drying) is carried out after the recording. However, the heating using the various heating means may be carried out in the transport path prior to the recording, so that the recording medium Pa is preheated prior to the recording. The preheating of the recording medium Pa prior to the recording is also effective in efficiently drying the ink adhered on the recording medium Pa at the time of the recording.

Next, a description will be given of an embodiment of a copying machine which uses the multi-nozzle ink-jet recording head described above which covers the entire recording width of the recording medium. Conventionally, a copying machine normally refers to an electrophotography type apparatus. But although the electrophotography type apparatus is popularly used, the operating principle is complex and the apparatus has a complex structure. On the other hand, the operating principle of the ink-jet recording apparatus is simple, and the ink-jet recording apparatus has a simple structure. Accordingly, this embodiment of the copying machine uses the ink-jet recording apparatus to realize a copying machine which operates on a simple operating principle and has an extremely simple structure.

Figure 6:
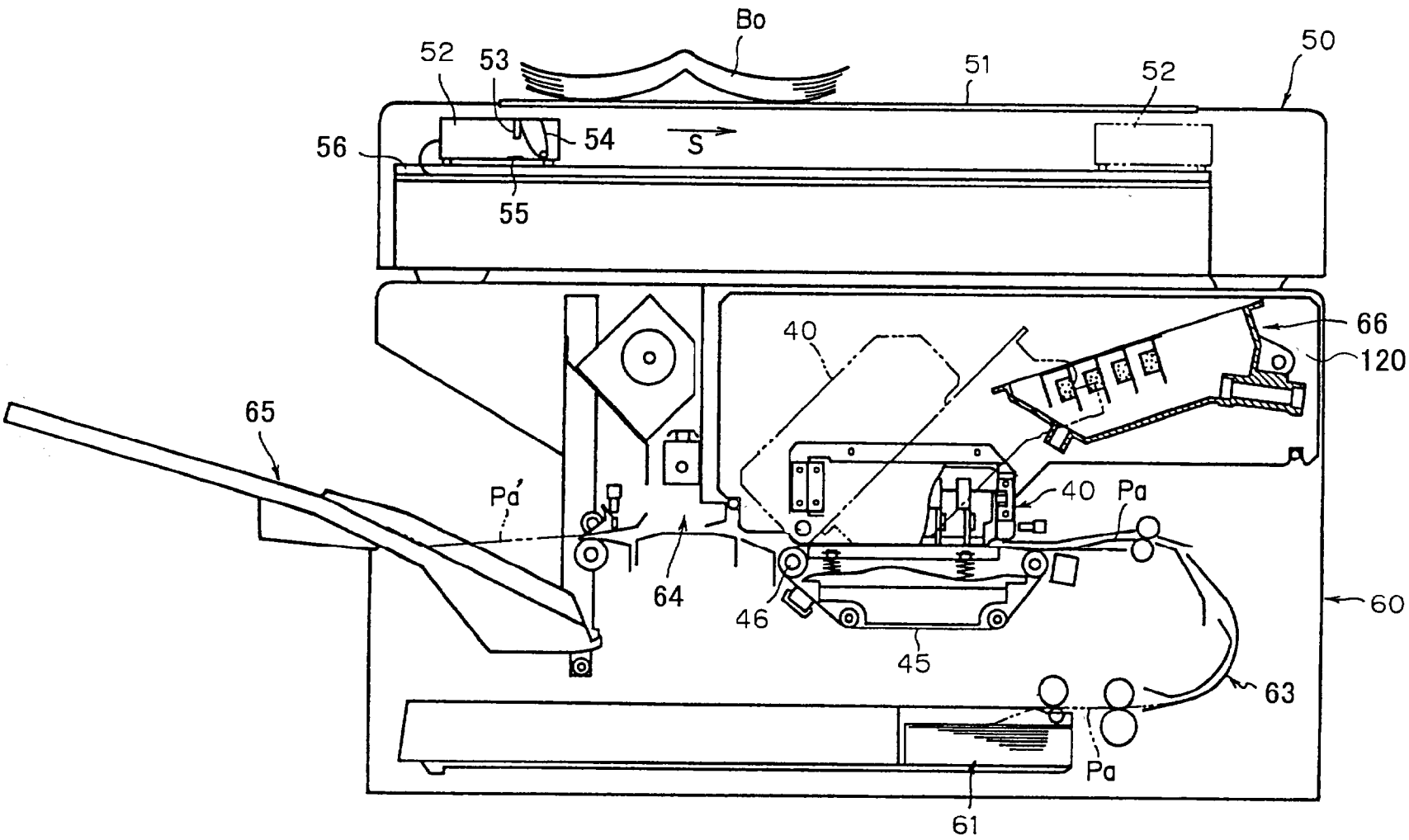
FIG. 6 is a diagram showing an embodiment of the copying apparatus according to the present invention employing the recording section.

FIG. 6 is a diagram showing this embodiment of the copying apparatus according to the present invention employing the recording section. The copying machine shown in FIG. 6 includes a scanner section 50 and an ink-jet printer section 60. The scanner section 50 reads an image of a document Bo which is placed on a document base 51, and successively forms image data of the document Bo. The image which is read is the image which is to be copied by the copying machine. The ink-jet printer section 60 includes a recording section 40, a medium transport section 45, an eject transport path 64, a supply and transport section 63, and a recovery processing unit 66.

The recording section 40 ejects and adheres the ink on the recording surface of the recording medium Pa based on the image data received from the scanner section 50, so as to record the image on the recording surface of the recording medium Pa. The medium transport section 45 is disposed below the recording section 40, and transports the recording medium Pa in the eject transport path 64 at a predetermined timing depending on the recording operation of the recording section 40. The eject transport path 64 ejects a recording medium Pa', which has been recorded with the image by the recording section 40, and is transported by the transport section 45, onto an eject tray section 65. The supply and transport section 63 successively supplies and transports the recording media Pa from the media supply section 61, one by one, to the recording section 40. The recovery processing unit 66 selectively carries out a recovery process with respect to each recording head of the recording section 40.

The scanner section 50 includes a document scan unit 52 for reading the image of the document Bo to be copied, a guide rail 56 for supporting the document scan unit 52 so that the document scan unit 52 is movable in a direction S and in a direction opposite to the direction S, and a driving section (not shown). The driving section drives the document scan unit 52 to move at a predetermined speed between a position indicated by a solid line and a position indicated by a two-dot chain line in FIG. 6, for example.

The document scan unit 52 includes a rod array lens 53, a color separation line sensor 55, and an exposure unit 55. The line sensor 55 is formed by a color image sensor for reading color information. For example, the line sensor 55 is a non-magnifying type sensor.

In a case where the document scan unit 52 is driven by the driving section to move and scan in the direction S so as to read the image of the document Bo which is placed on the document base 51 made of a transparent material, an exposure lamp within the exposure unit 52 is turned ON, and the reflected light from the document Bo is converged at the line sensor 55 via the rod array lens 53. The line sensor 55 reads the color image information of the reflected light for each color and converts the color image information into electrical digital signals. The digital signals are supplied as image data to a control unit within the ink jet printer section 60. Hence, each recording head within the recording section 40 ejects the ink of a corresponding color depending on a driving control pulse signal based on the image data.

The recording media Pa having a predetermined standardized size are stacked in the media supply section 61. When a driving motor (not shown) is driven the recording media Pa are picked up one by one by a pickup roller unit 62 and supplied to the supply and transport section 63.

According to the ink-jet recording, the ink drops are ejected and adhered on the recording surface of the recording medium Pa. Hence, the ink adhered on the recording surface of the recording medium Pa should not spread and/or run unnecessarily to blur the recorded image. In addition, it is desirable that the recording medium Pa has properties such that the ink adhered on the recording surface of the recording medium Pa is quickly absorbed into the recording medium Pa. Preferably, the recording medium Pa has properties such that the phenomenon such as running, spreading and/or mixing of the inks of different colors does not occur, even if the inks of different colors are adhered at the same position on the recording surface of the recording medium Pa within a short period of time, so that the spreading of the recorded dots is suppressed to such an extent that the sharpness of the recorded image will not deteriorate.

Properties of plain paper and ordinary recording paper used on the electrophotography type copying machine may not be sufficient to satisfy the desired properties of the recording medium Pa described above. The plain paper and ordinary recording paper can obtain a satisfactory image quality in most cases where the ink-jet recording is made using only one or two colors so that the number of overlapping inks of different colors on the paper is two at the maximum. But in the case of the full color ink-jet recording using three or more colors, the amounts of inks of the different colors adhered on the paper become large, and it may become difficult to maintain the desired image quality.

In order to positively satisfy the desired properties of the recording medium Pa, a predetermined coating may be formed on the surface of the paper such as the plain paper and ordinary recording paper. For example, the predetermined coating may be made of fine silica powder.

In this embodiment of the copying machine, the thermal fixing unit covers a range greater than the width of the recording surface of the recording medium, and there is reserve in the fixing capability. Accordingly, the ink adhered on the recording surface of the recording medium can be dried and fixed instantaneously, thereby preventing ink before being dried from permeating to the surface opposite from the recording surface of the recording medium even when the copying is successively carried out. For this reason, it is possible to obtain high-quality copies on the recording media at a high speed and with a high image quality. The use of the multi-nozzle ink-jet recording head which covers the entire recording width of the recording surface on the recording medium enables the copying to be carried out at an extremely high speed due to the extremely large number of ink-jet nozzles provided on the ink-jet recording head. In addition, because this embodiment of the copying machine has the reserve fixing capability, it is possible to sufficiently bring out the advantageous effects achieved by the use of the multi-nozzle ink-jet recording head.

Figure 7A:
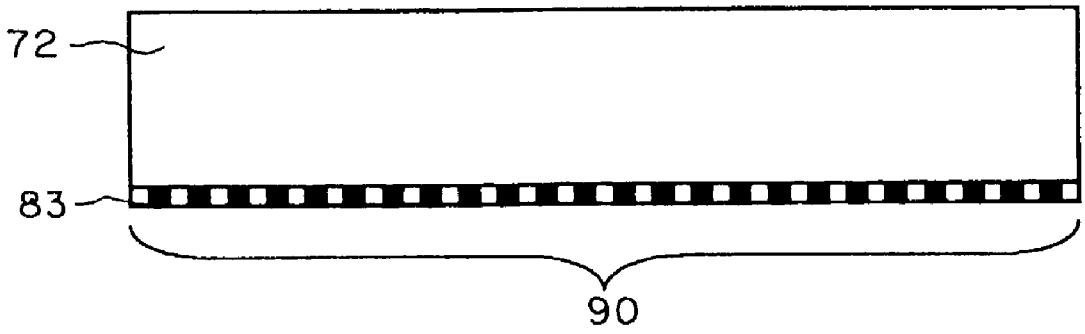
FIGS. 7A through 7C are cross sectional views for explaining the recording head.
Figure 7B:
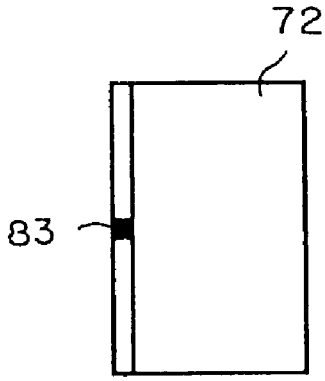
Figure 7C:
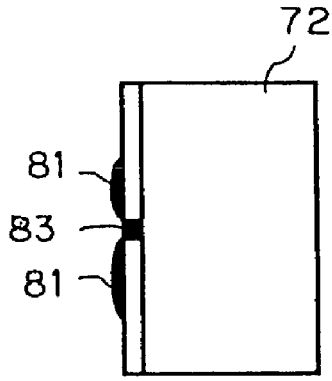

FIGS. 7A through 7C are cross sectional views for explaining the multi-nozzle ink-jet recording head which covers the recording width of the recording surface on the recording medium. FIG. 7A shows the cross section of the recording head along the longitudinal direction thereof. FIGS. 7B and 7C respectively show the cross sections of the recording head shown in FIG. 7A cut along a plane perpendicular to the paper in FIG. 7A and viewed from the side. The recording head shown in FIGS. 7A through 7C includes nozzles 83 indicated in black, a head block 72, and a multi-nozzle array region 90. Although not all of the nozzles 83 can be shown in FIG. 7A, the nozzles 83 are arranged with an array density of 400 dpi to 2400 dpi, for example. Hence, several thousand to several ten thousand nozzles 83 are actually provided. The multi-nozzle array region 90 covers the entire recording width of the recording surface of the recording medium.

In the case of the multi-nozzle ink-jet recording head, a large amount of ink is ejected from the nozzles 83. Hence, even if a slight erroneous ejection or drifting ink mist exists per nozzle 83, unnecessary ink 81 may accumulate in a vicinity of the nozzle 83 as shown in FIG. 7C due to the extremely large number of nozzles 83. If the unnecessary ink 81 dries and solidifies, the unnecessary ink 81 may cause clogging of the nozzle 83. Hence, the unnecessary ink 81 must be quickly removed and cleaned to prevent the clogging.

In addition to the unwanted ink 81, the clogging of the nozzle 83 may be caused by drifting duet particles, foreign particles, paper powder or particles and the like in the surrounding air. Such particles may mix into the ink and cause the clogging of the nozzle 83 when dried and solidified together with the ink. Moreover, the unwanted ink 81 and the carbon dioxide within the surrounding air may react to generate unwanted deposition in the vicinity of the nozzle 83 to cause the clogging.

In any case, it is essential to provide a reliability maintaining mechanism, that is, a clogging preventing means, for quickly removing and cleaning the contamination such as the unwanted ink 81 and foreign particles, so that the ink in the vicinity of the nozzle 83 will not dry and solidify. In addition, it is desirable that such a reliability maintaining mechanism functions effectively. The mechanism provided in the present invention can satisfy such demands.

Figure 8A:
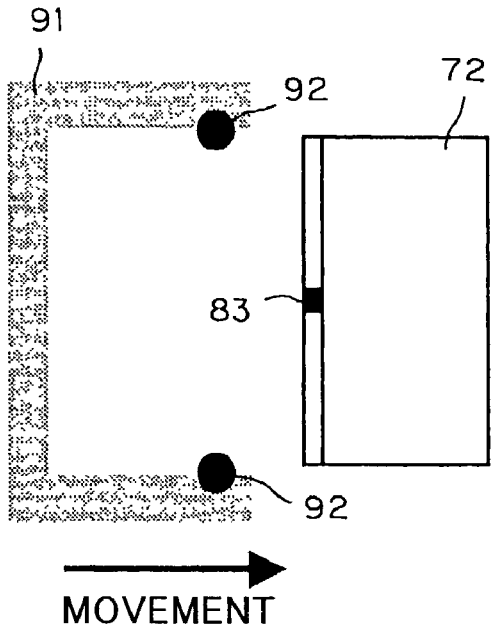
FIGS. 8A and 8B are diagrams for explaining a cap provided with respect to the recording head.
Figure 8B:
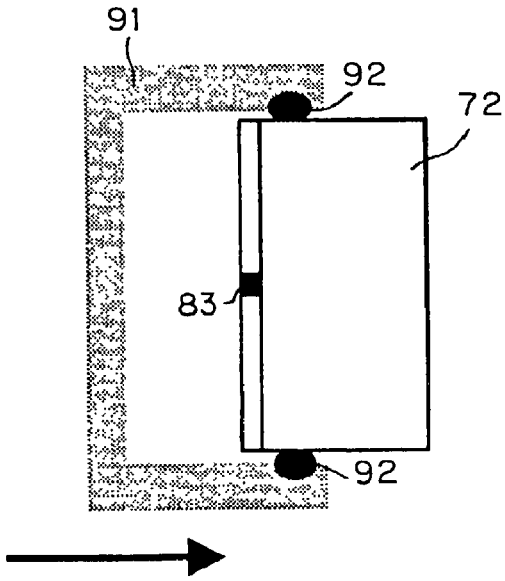

FIGS. 8A and 8B are diagrams for explaining a cap 91 provided with respect to the recording head so as to prevent the ink from drying and solidifying. The cap 91 moves in a direction indicated by an arrow in FIG. 8A with respect to the head block 72. A sealing member 92 is provided on the cap 91, so as to provide an air-tight seal when the cap 91 covers the head block 72 as shown in FIG. 8B. The sealing member 92 is made of a resilient material such as rubber and having dimensions which take into consideration a squeeze of approximately 10% to 50%.

Figure 9:
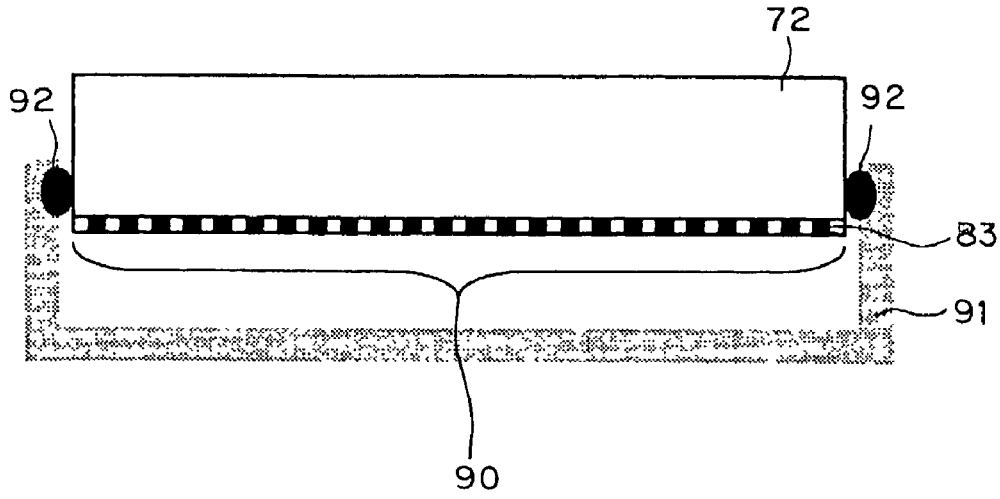
FIG. 9 is a diagram showing a relationship of a multi-nozzle array region and the cap.

FIG. 9 is a diagram showing a relationship of the multi-nozzle array region 90 and the cap 91. The internal dimensions of the cap 91 are slightly larger than the dimensions of the multi-nozzle array region 90, by taking into consideration the squeeze of the sealing member 92 which is made of a sufficiently compliant material. The internal dimensions of the cap 91 are slightly larger than the dimensions of the multi-nozzle array region 90, in order to efficiently clean the multi-nozzle array region 90 by various cleaning means which will be described later.

If the internal dimensions of the cap 91 and the dimensions of the multi-nozzle array region 90 were the same, unlike in this embodiment, the right and left end portions of the multi-nozzle array region 90 will become too close to the inner side of the cap 91, thereby making it difficult to sufficiently clean the multi-nozzle array region 90 by the cleaning means which will be described later. In other words, if the right and left end portions of the multi-nozzle array region 90 are too close to the inner side of the cap 91, a blade or an ink absorbing member which is used as the cleaning means will hit the inner side of the cap 91, and the multi-nozzle array region 90 cannot be cleaned efficiently to the right and left end portions thereof.

On the other hand, according to this embodiment, such a problem can be avoided and the multi-nozzle array region 90 can be efficiently cleaned to the right and left portions thereof, because the internal dimensions of the cap 91 are slightly larger than the dimensions of the multi-nozzle array region 90.

Figure 10:
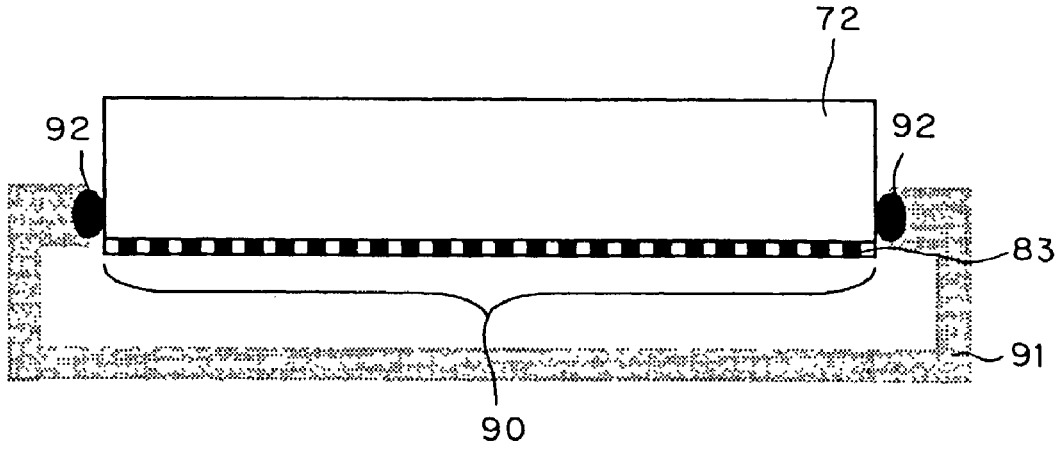
FIG. 10 is a diagram showing another relationship of the multi-nozzle array region and the cap.

FIG. 10 is a diagram showing another relationship of the multi-nozzle array region 90 and the cap 91. According to the cap 91 shown in FIG. 10, the internal dimensions of the cap 91 are positively larger than the dimensions of the multi-nozzle array region 90. In this case, it is possible to efficiently clean the multi-nozzle array region 90 to the right and left portions thereof because of the reserve provided between the internal dimensions of the cap 91 and the dimensions of the multi-nozzle array region 90, as compared to the case where the internal dimensions of the cap 91 and the multi-nozzle array region 90 are the same and no reserve is provided. Therefore, this embodiment enables satisfactory cleaning of the multi-nozzle array region 90 by the cleaning means which will be described later.

Figure 11A:
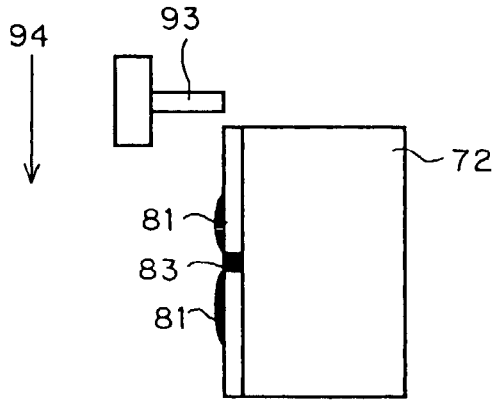
FIGS. 11A through 11C are diagrams for explaining a first embodiment of a cleaning means.
Figure 11B:
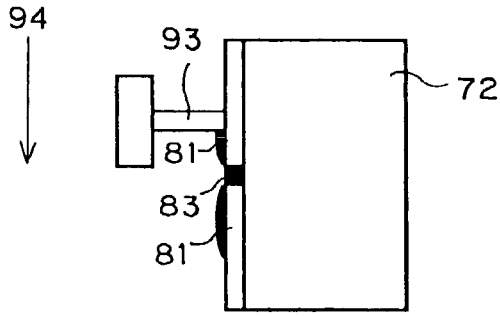
Figure 11C:
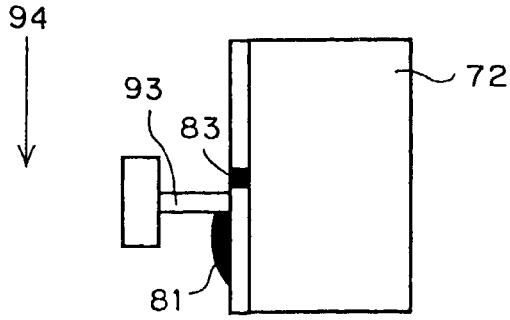

FIGS. 11A through 11C are diagrams for explaining a first embodiment of the cleaning means. As shown in FIGS. 11A through 11C, the cleaning means includes a blade 93 which moves in a direction 94 when removing the unwanted ink 81 adhered in the vicinity of the nozzle 83 and cleaning the nozzle 83, as shown sequentially in FIGS. 11A through 11C. Of course, it is possible to move the head block 72 in place of the blade 93. In other words, a relative movement of the blade 93 and the head block 72 achieves the object of removing and cleaning the nozzle 83.

Because the blade 93 makes direct contact with the nozzle 83, it is important that the blade 93 does not damage the nozzle 83 upon contact. Hence, it is desirable to use a soft material such as plastic and rubber for the blade 93, and hard materials such as metal is undesirable for use as the blade 93. It is preferable that the blade 93 is made of a resilient material which is sufficiently compliant so as to follow the surface of the multi-nozzle array region 90 while the relative movement occurs between the blade 93 and the multi-nozzle array region 90. Furthermore, it is desirable to form the blade 93 from a material such as silicone rubber which is also corrosion resistant against the ink. In FIGS. 11A through 11C, the blade 93 is not deformed when moving against the head block 72, however, the blade 93 may be resiliently deformed when moving against the head block 72 due to the resiliency of the material used for the blade 93.

Figure 12A:
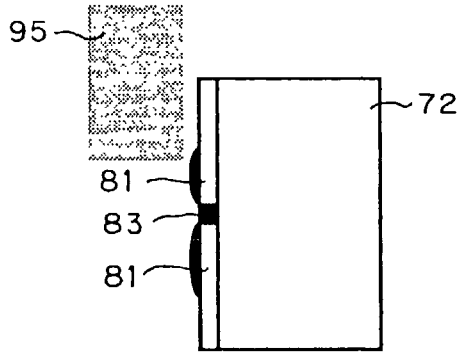
FIGS. 12A through 12C are diagrams for explaining a second embodiment of the cleaning means.
Figure 12B:
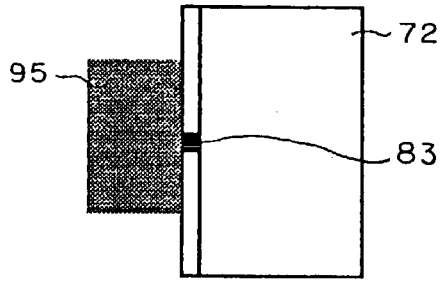
Figure 12C:
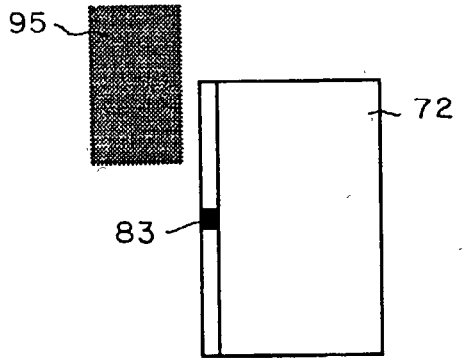

FIGS. 12A through 12C are diagrams for explaining a second embodiment of the cleaning means. As shown in FIGS. 12A through 12C, the cleaning means includes an ink absorbing member 95 which moves when removing the unwanted ink 81 adhered in the vicinity of the nozzle 83 and cleaning the nozzle 83, as shown sequentially in FIGS. 12A through 12C. FIG. 12C shows the ink absorbing member 95 after absorbing the unwanted ink 81. The ink absorbing member 95 is made of a sponge material such as polyurethane foam, which is capable of efficiently absorbing liquid. Of course, it is possible to move the head block 72 in place of the ink absorbing member 95. In other words, a relative movement of the ink absorbing member 95 and the head block 72 achieves the object of removing and cleaning the nozzle 83.

Of course, the ink absorbing member 95 may make sliding contact with the nozzle 83 or, simply make contact with the nozzle 83, when cleaning the nozzle 83.

Figure 13A:
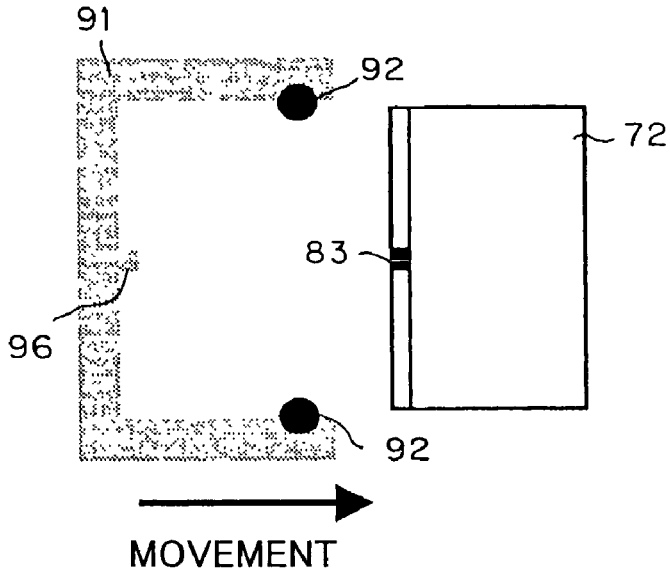
FIGS. 13A and 13B are diagrams for explaining a third embodiment of the cleaning means.
Figure 13B:
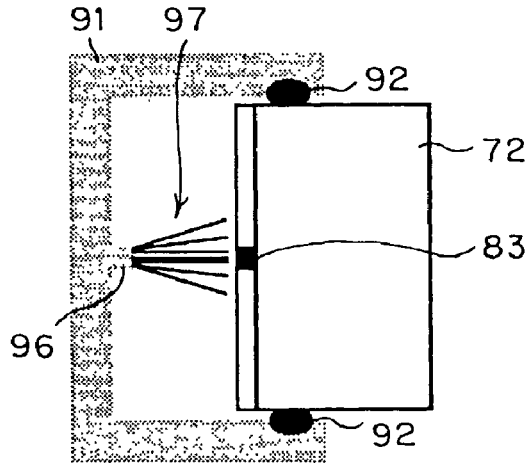

FIGS. 13A and 13B are diagrams for explaining a third embodiment of the cleaning means. As shown in FIGS. 13A and 13B, at least one cleaning nozzle 96 is provided within the cap 91. When the cap 91 moves in a direction indicated by an arrow in FIG. 13A with respect to the head block 72 and the cap 91 covers the head block 72 as shown in FIG.

13B, a cleaning solution 97 is sprayed with respect to the nozzle 83 from the cleaning nozzle 96 to clean the unwanted ink 81 and the contaminations such as dust particles adhered in the vicinity of the nozzle 83.

For example, in a case where a main component of the ink is water, such as the case of black ink made up of 75% water, 18% glycerol, 4.8% ethyl alcohol, and 2.2% dye (for example, C.I. direct black), water may be used as the cleaning solution. However, the cleaning solution is not limited to water, and it is desirable for the cleaning solution to have the same PH as the ink, so as not to generate unwanted reaction between the cleaning solution and the ink to cause unwanted deposition. Moreover, it is more preferable to use as the cleaning solution a liquid (vehicle) which is obtained by removing the dye component from the ink component. In this case, an additive such as NaOH may be added to adjust the PH of the liquid (vehicle) so that the PH of the cleaning solution is the same as the PH of the ink.

Figure 14:
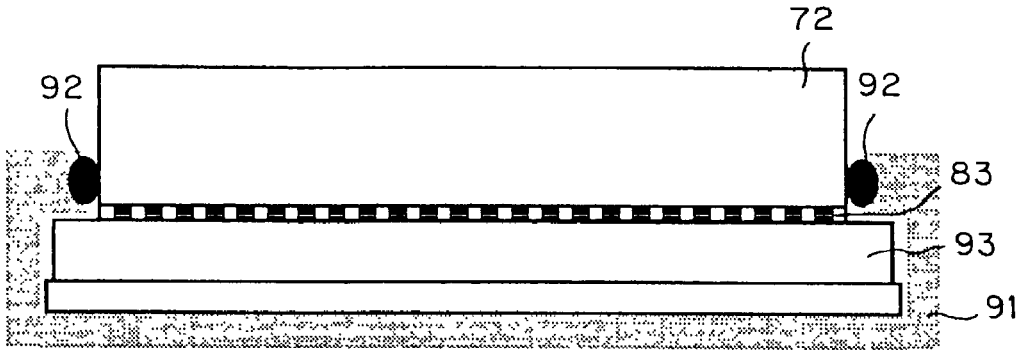
FIG. 14 is a diagram showing a positional relationship of the cleaning means and the multi-nozzle array region.
Figure 15:
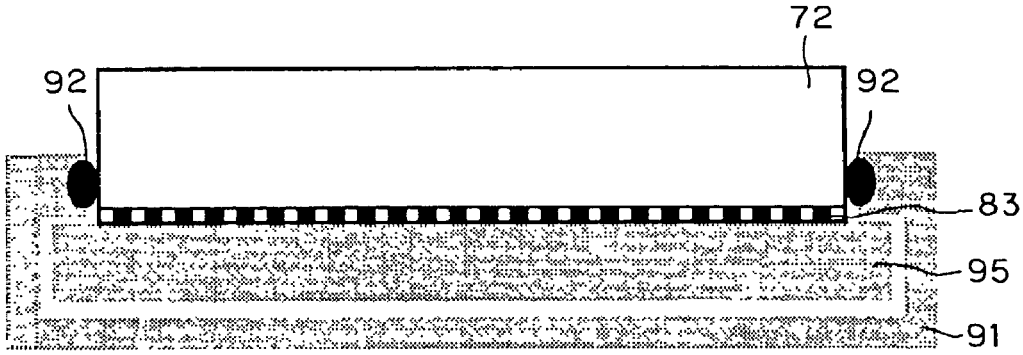
FIG. 15 is a diagram showing another positional relationship of the cleaning means and the multi-nozzle array region.
Figure 16:
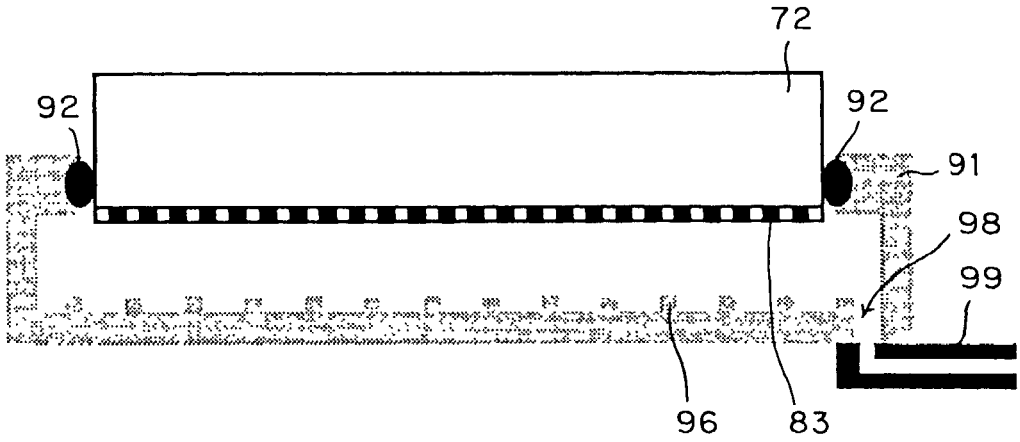
FIG. 16 is a diagram showing still another positional relationship of the cleaning means and the multi-nozzle array region.

FIGS. 14 through 16 respectively are diagrams showing a positional relationship of the cleaning means shown in FIGS. 11 through 13 and the multi-nozzle array region 90. As may be seen from FIGS. 14 through 16, each of the cleaning means (93, 95, 96) shown in FIGS. 11 through 13 covers a range greater than the multi-nozzle array region 90, so that the multi-nozzle array region 90 can be cleaned efficiently even to the right and left end portions of the multi-nozzle array region 90. The internal dimensions of the cap 91 are larger than the dimensions of each of the cleaning means (93, 95, 96), so that each of the cleaning means can be accommodated within the cap 91 and realize a reliability maintaining mechanism or a recovery unit having a compact structure.

In FIG. 16, an drain outlet 98 is provided to drain unwanted liquid such as the removed ink and cleaning solution outside the cap 91. A drain tube 99 may be connected to the drain outlet 98, so that the unwanted liquid is drained outside the cap 91 via the drain outlet 98 and the drain tube 99.

Compared to the serial type ink-jet recording apparatus, this embodiment of the ink-jet recording apparatus has a more complicated layout of elements because the multi-nozzle ink-jet recording head covers the entire recording width of the recording surface of the recording medium. For this reason, the layout of the elements may become difficult if the drain tube 99 is long. Accordingly, the drain outlet 98 is located at an asymmetrical position along the longitudinal direction of the cap 91, that is, at a bottom right portion of the cap 91 as shown in FIG. 16, so that the drain tube 99 can be made short.

Figure 17:
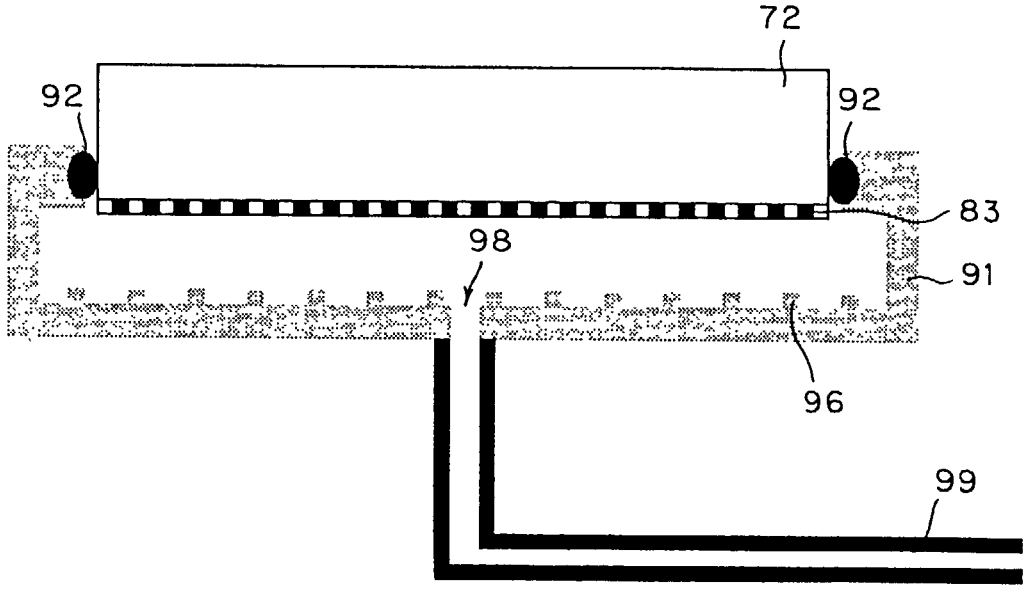
FIG. 17 is a diagram showing a comparison example for explaining effects of an drain outlet position employed in the present invention.

FIG. 17 is a diagram showing a comparison example for explaining effects of a drain outlet position employed in the present invention. In FIG. 17, those parts which are the same as those corresponding parts in FIG. 16 are designated by the same reference numerals, and a description thereof will be omitted. If the drain outlet 98 is located at a central position of the cap 91, that is, at a bottom center of the cap 91 as shown in FIG. 17, the drain tube 99 becomes long, and the layout of this drain tube 99 may become difficult.

But when the drain outlet 98 is located at the asymmetrical position along the longitudinal direction of the cap 91 as shown in FIG. 16, the length of the drain tube 99 can be minimized, thereby facilitating the layout of the drain tube 99.

Figure 18:
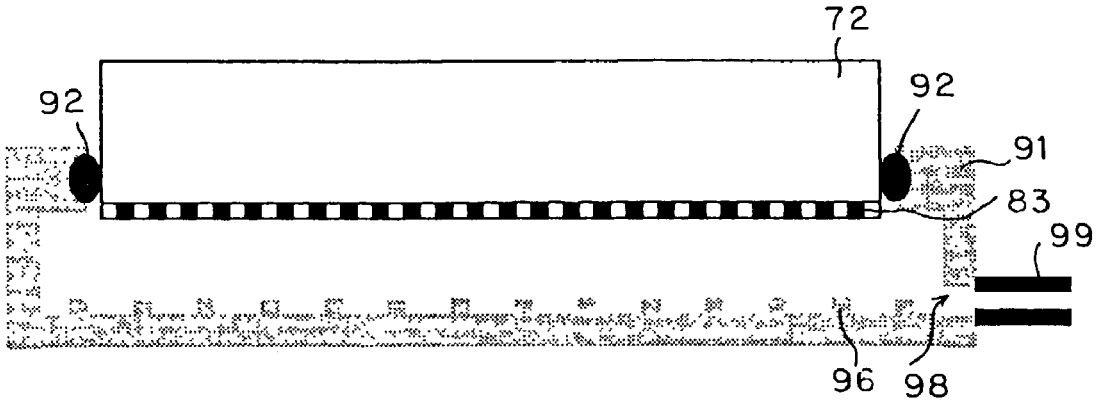
FIG. 18 is a diagram showing another drain outlet position employed in the present invention.

FIG. 18 is a diagram showing another drain outlet position employed in the present invention. In FIG. 18, the drain outlet 98 is also located at an asymmetrical position along the longitudinal direction of the cap 91, that is, at a right side portion of the cap 91 as shown in FIG. 18, so that the drain tube 99 can be made considerably short compared to the comparison example shown in FIG. 17.

Figure 19:
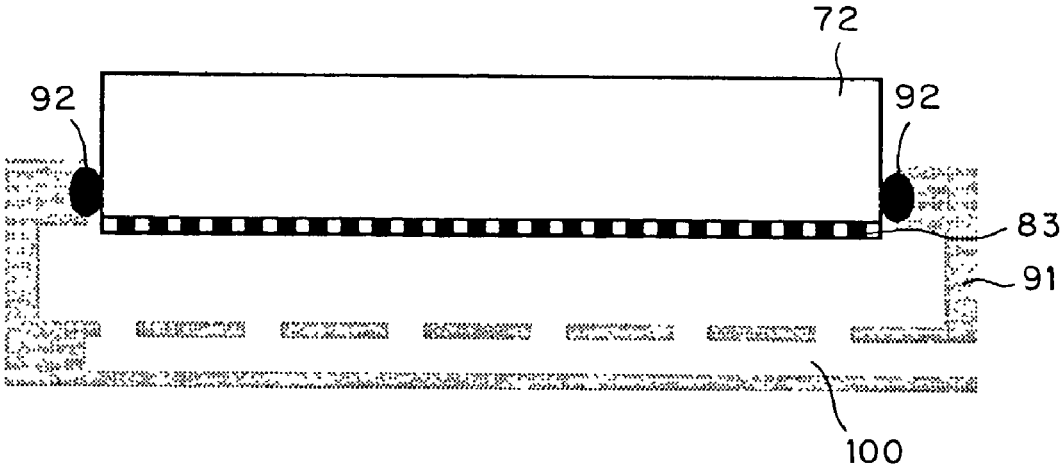
FIG. 19 is a diagram showing a flow passage provided within a wall of a cap.

FIG. 19 is a diagram showing a flow passage provided within a wall of a cap. In FIG. 19, the unwanted liquid is drained via a flow passage 100 which is provided within the wall of the cap 91. By providing the flow passage 100 within the wall of the cap 91, it becomes unnecessary to provide a long drain tube 99 as in the case of the comparison example shown in FIG. 17. Hence, it is possible to realize a reliability maintaining mechanism or a recovery unit having a compact structure.

The unwanted liquid such as the unwanted ink 81 and the cleaning solution is drained outside the cap 91 via the drain outlet 98 and the drain tube 99, by gravity or capillary action, without applying an external force on the unwanted liquid. Hence, the unwanted liquid can be drained outside the cap 91 without affecting the cleaned nozzle surface of the recording head. But if a more efficient draining of the unwanted liquid is desired, the unwanted liquid may be drained outside the cap 91 by vacuum suction. The use of vacuum suction to positively drain the unwanted liquid outside the cap 91 is particularly effective in this case because the nozzles 83 are provided to cover the recording width of the recording surface of the recording medium and the number of nozzles 83 is approximately several thousand to several ten thousand and extremely large, and the amount of the unwanted liquid is large due to the large amounts of ink, unwanted ink and cleaning solution present.

The reliability maintaining mechanism or the recovery unit described above is provided with respect to one head block 71. However, in the case of the color ink-jet recording apparatus and the copying apparatus shown in FIGS. 5 and 6 described above, the reliability maintaining mechanism or the recovery unit must be provided with respect to each head block 71 corresponding to each of the colors (inks) used for the recording.

On the other hand, in the case of the color ink-jet recording apparatus and the copying apparatus, it is possible to provide a common recovery unit 120 which is shared by each of the recording heads of the recording section 40 as shown in FIG. 6. In this case, the common recovery unit 120 selectively carries out the recovery process with respect to each of the recording heads of the recording section 40. But more preferably, the reliability maintaining mechanism or recovery unit is provided independently for each head corresponding to each color, because this would prevent the inks having different colors from being mixed.

When the ink of a certain color adheres in the vicinity of the nozzle 83 from which the ink of another color is ejected, the inks of the different colors may mix at the nozzle 83 and cause unwanted deposition and clogging of the nozzle 83. In this case, the cleaning effect of the reliability maintaining mechanism or recovery unit with respect to the multi-nozzle array region 90 is greatly deteriorated.

Figure 20:
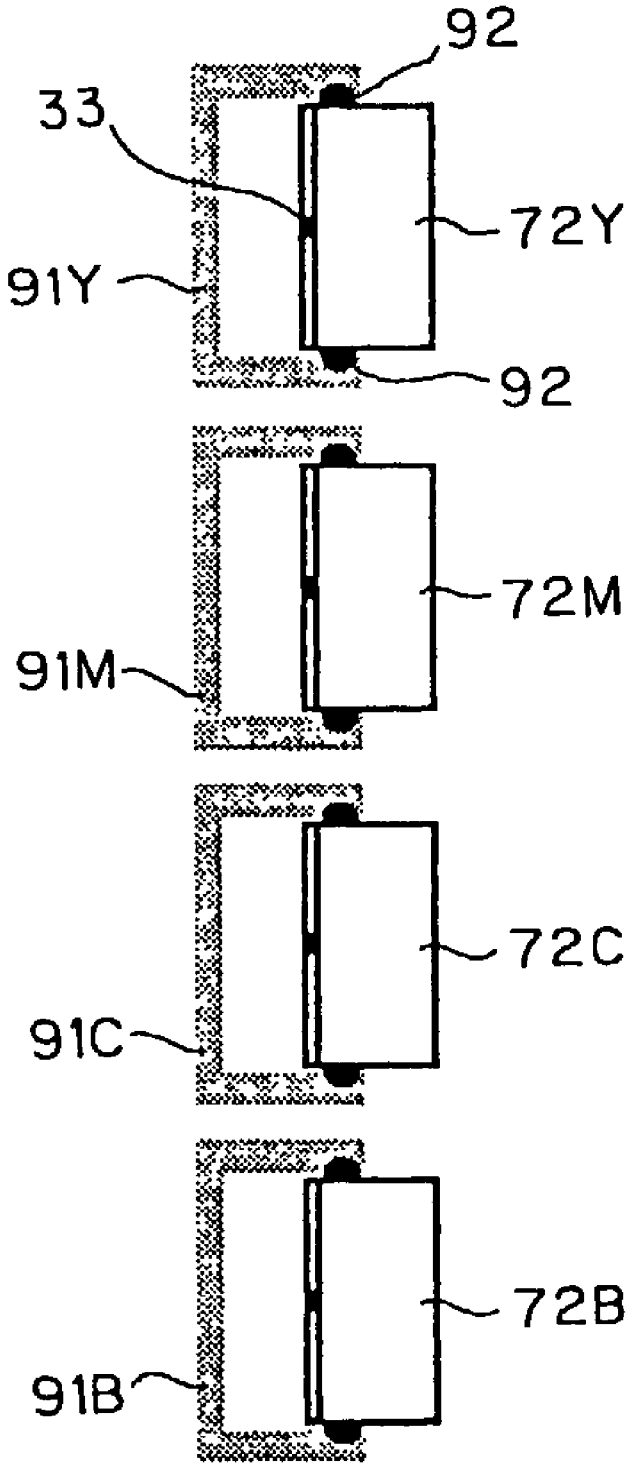
FIG. 20 is a diagram showing a recording section of a color ink-jet recording apparatus having a cap provided independently for each of a plurality of colors.

FIG. 20 is a diagram showing a recording section of a color ink-jet recording apparatus having a cap provided independently for each of a plurality of colors. In FIG. 20, each of caps 91Y, 91M, 91C and 91B have the same structure as the cap 91 shown in FIG. 8 or 9, but are provided independently with respect to the corresponding head blocks 72Y, 72M, 72C and 72B respectively provided for the recording using the yellow ink, magenta ink, cyan ink and black ink. Since the caps 91Y, 91M, 91C and 91B are independent of each other, each of the head blocks 72Y, 72M, 72C and 72B is prevented from being contaminated by the ink from the adjacent head block of a different color.

Hence, it is possible to prevent unwanted mixture of different inks, unwanted chemical reaction of the different inks unwanted deposition caused by such a chemical reaction, and unwanted clogging of the nozzle 83 in each of the head blocks 72Y, 72M, 72C and 72B.

Figure 21:
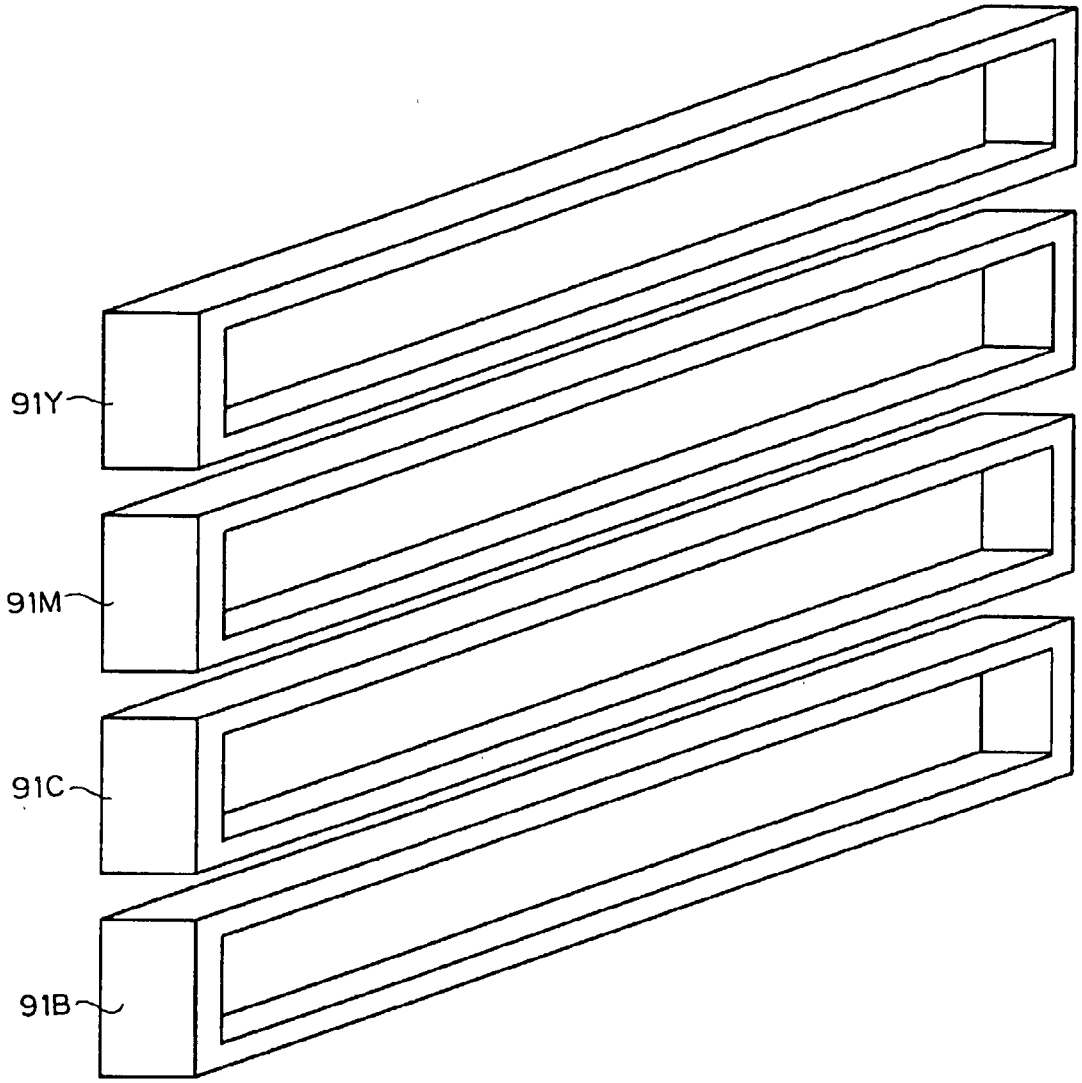
FIG. 21 is a perspective view showing the caps shown in FIG. 20.

FIG. 21 is a perspective view showing the caps 91Y, 91M, 91C and 91B shown in FIG. 20. In FIG. 21, the illustration of the sealing member 92 shown in FIG. 20 is omitted.

Figure 22:
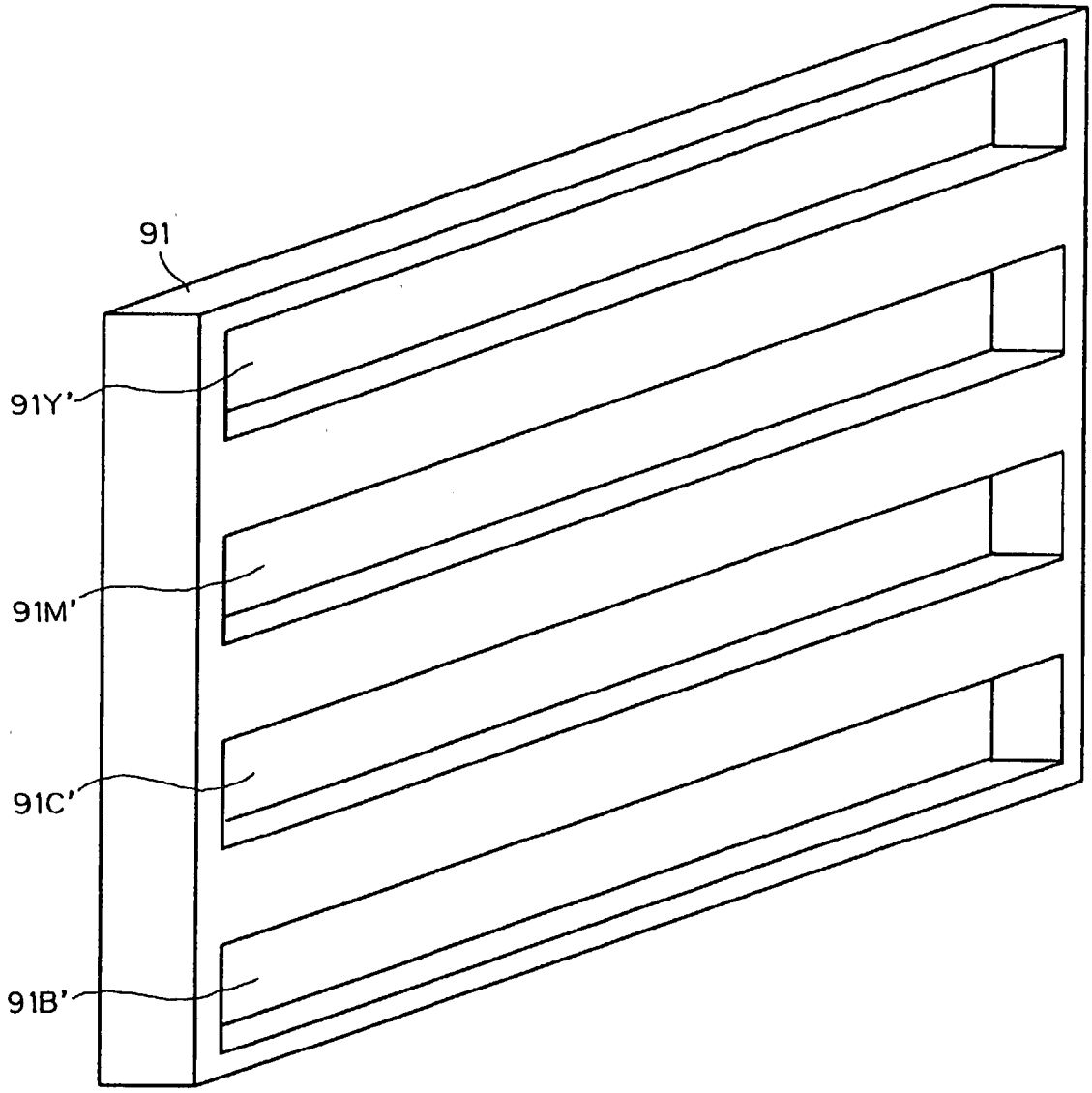
FIG. 22 is a perspective view showing the caps having an integrated structure.

FIG. 22 is a perspective view showing the caps having an integrated structure. A cap 91 shown in FIG. 22 has an integrated structure including cap regions 91Y', 91M', 91C' and 91B' respectively corresponding to the caps 91Y, 91M, 91C and 91B shown in FIG. 21 which are provided with respect to the corresponding head blocks 72Y, 72M, 72C and 72B.

FIGS. 23 through 27 are diagrams showing recording sections of a color ink-jet recording apparatus having caps with the integrated structure respectively provided independently for the corresponding colors. In FIGS. 23 through 27, each of the head blocks 72Y, 72M, 72C and 72B is held on a head block holding member 101 to form a head block unit. The cap 91 has an integrated structure including cap regions respectively corresponding to the caps 91Y, 91M, 91C and 91B shown in FIG. 21. Each cap region is sealed by a sealing member 92, so that inks of different colors will not become mixed.

Figure 23:
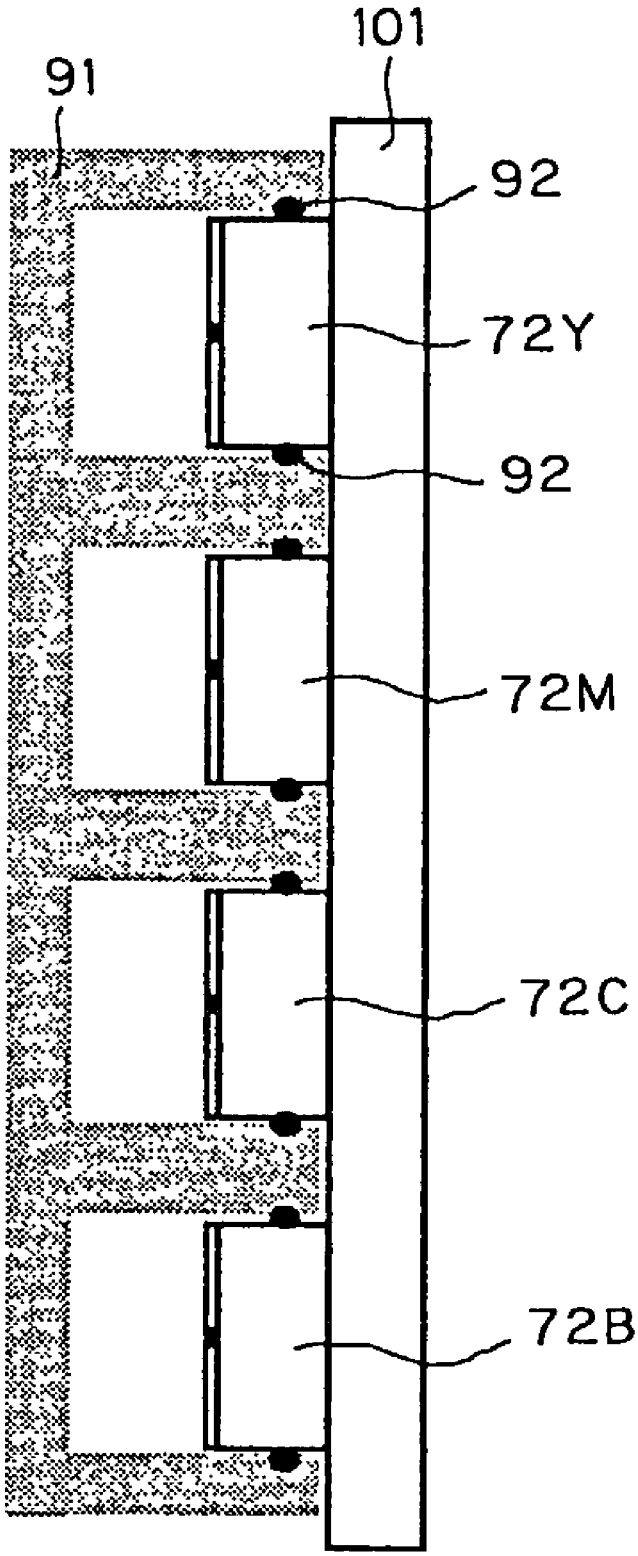
FIG. 23 is a diagram showing a recording section of a color ink-jet recording apparatus having caps with the integrated structure respectively provided independently for the corresponding colors.
Figure 24:
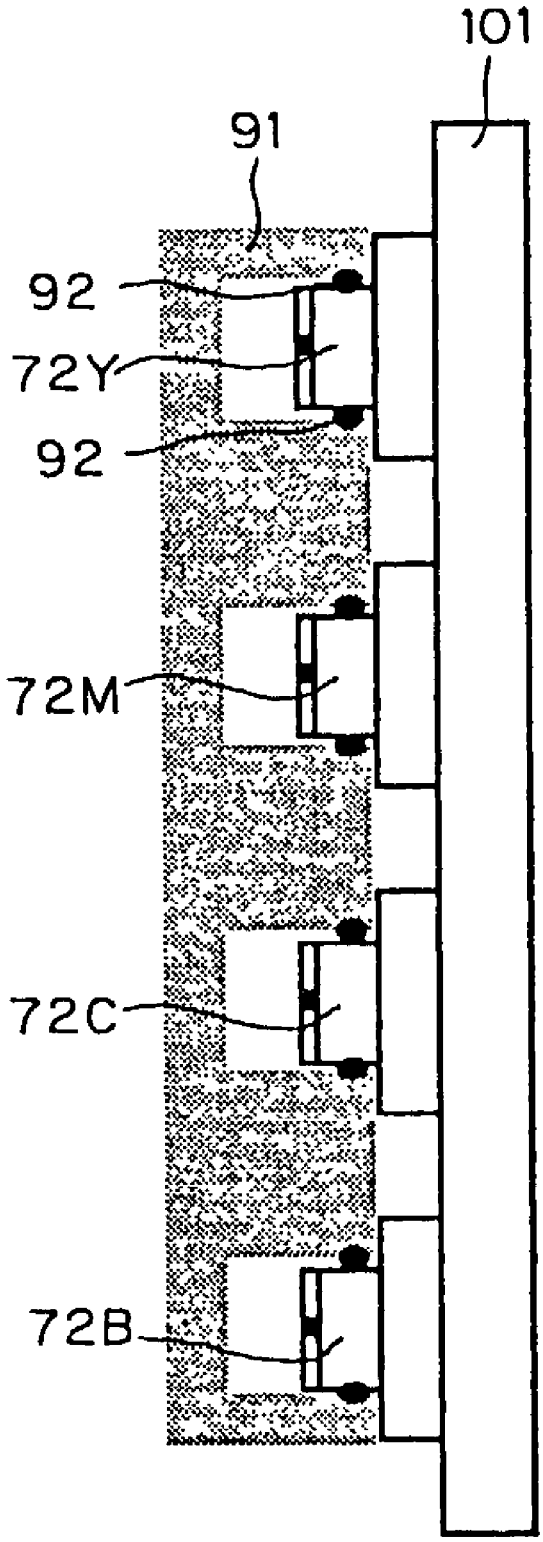
FIG. 24 is a diagram showing a recording section of a color ink-jet recording apparatus having caps with the integrated structure respectively provided independently for the corresponding colors.
Figure 25:
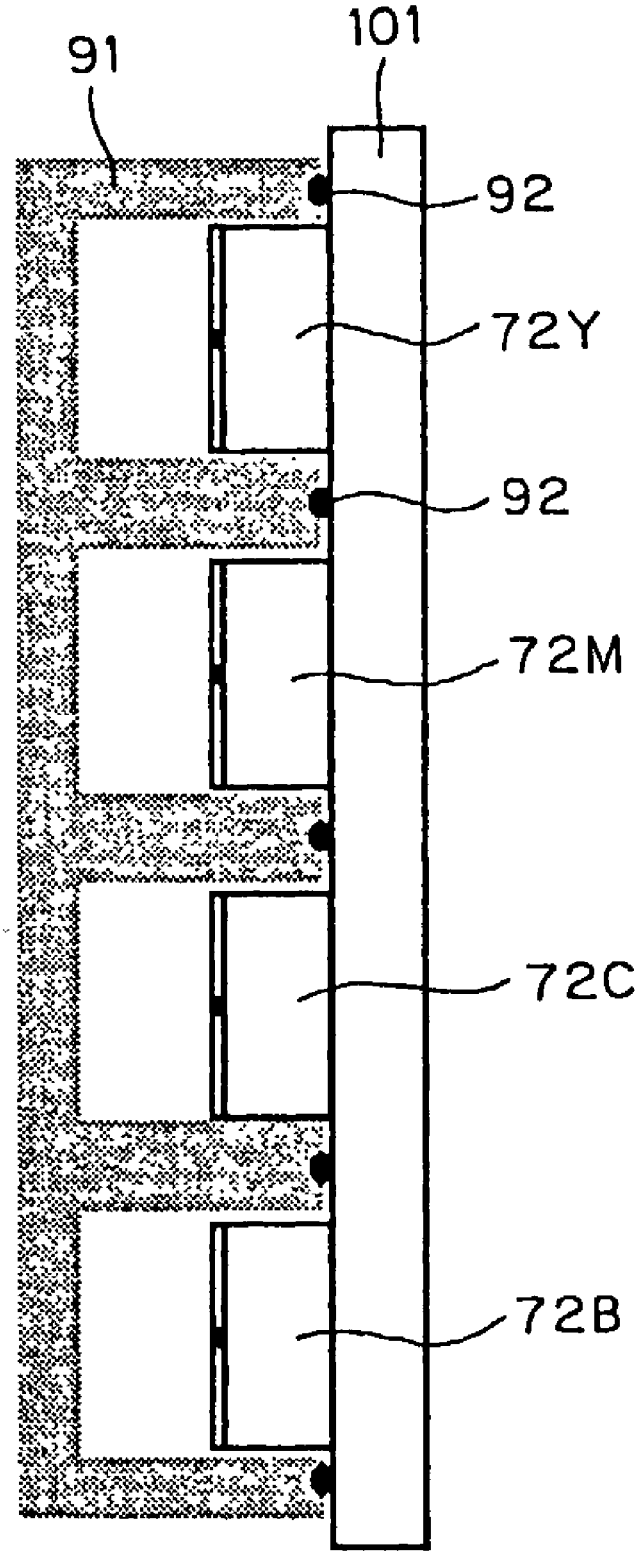
FIG. 25 is a diagram showing a recording section of a color ink-jet recording apparatus having caps with the integrated structure respectively provided independently for the corresponding colors.
Figure 26:
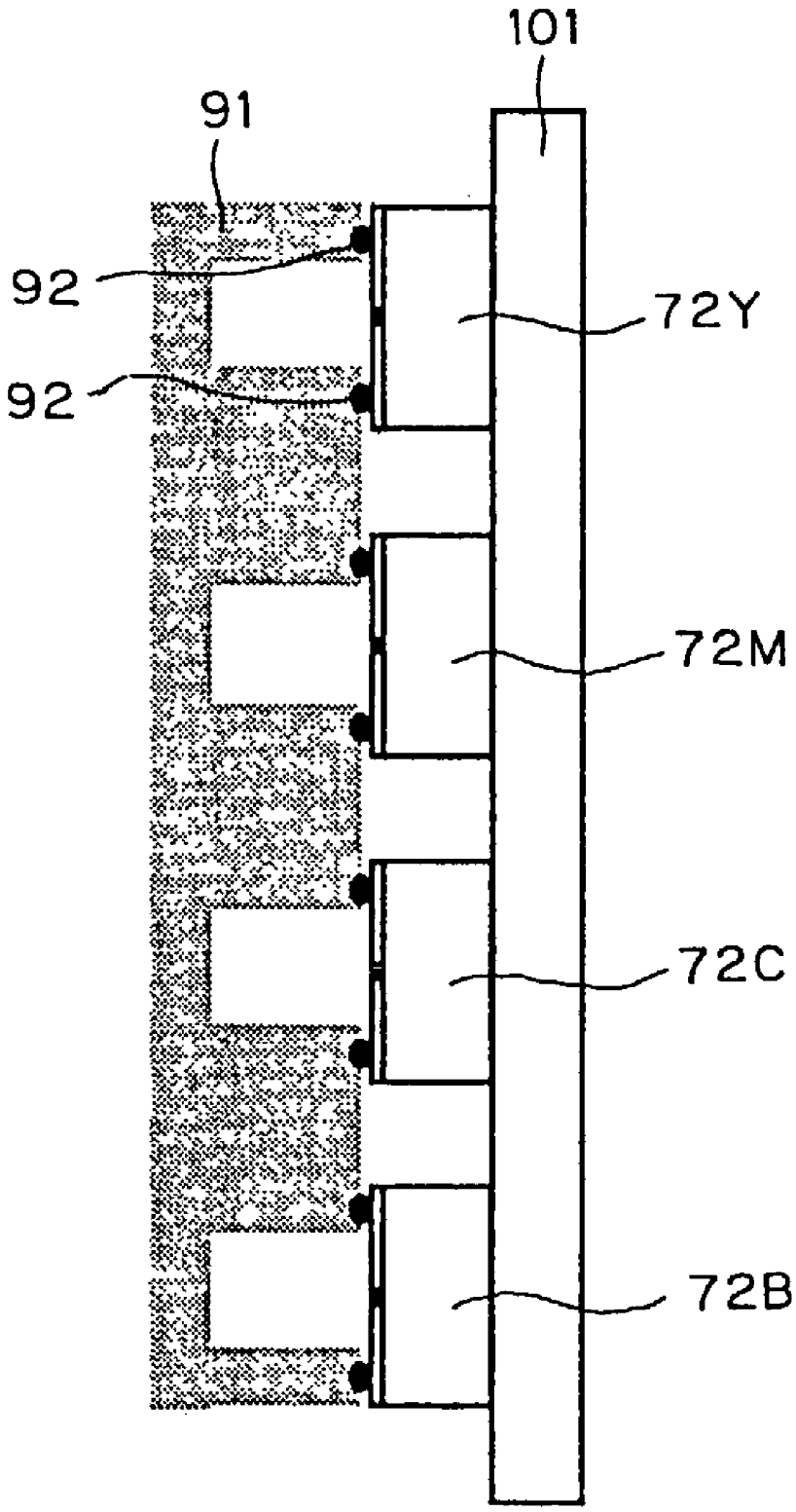
FIG. 26 is a diagram showing a recording section of a color ink-jet recording apparatus having caps with the integrated structure respectively provided independently for the corresponding colors.
Figure 27:
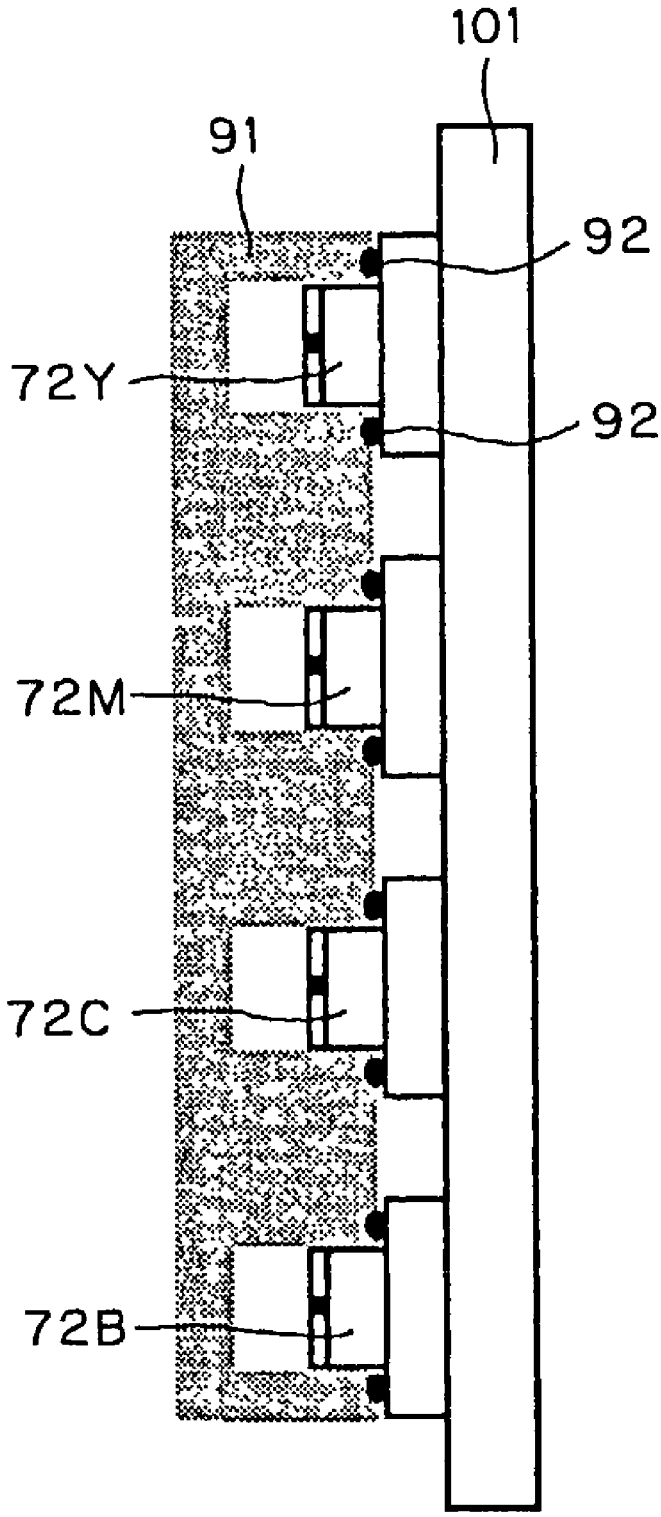
FIG. 27 is a diagram showing a recording section of a color ink-jet recording apparatus having caps with the integrated structure respectively provided independently for the corresponding colors.

In FIGS. 23 and 24, the sealing member 92 is disposed on the side surface of each of the head blocks 72Y, 72M, 72C and 72B. In FIG. 26, the sealing member 92 is disposed on around the multi-nozzle array region. In FIGS. 25 and 27, the sealing member 92 is disposed on the head block holding member 101.

Figure 28:
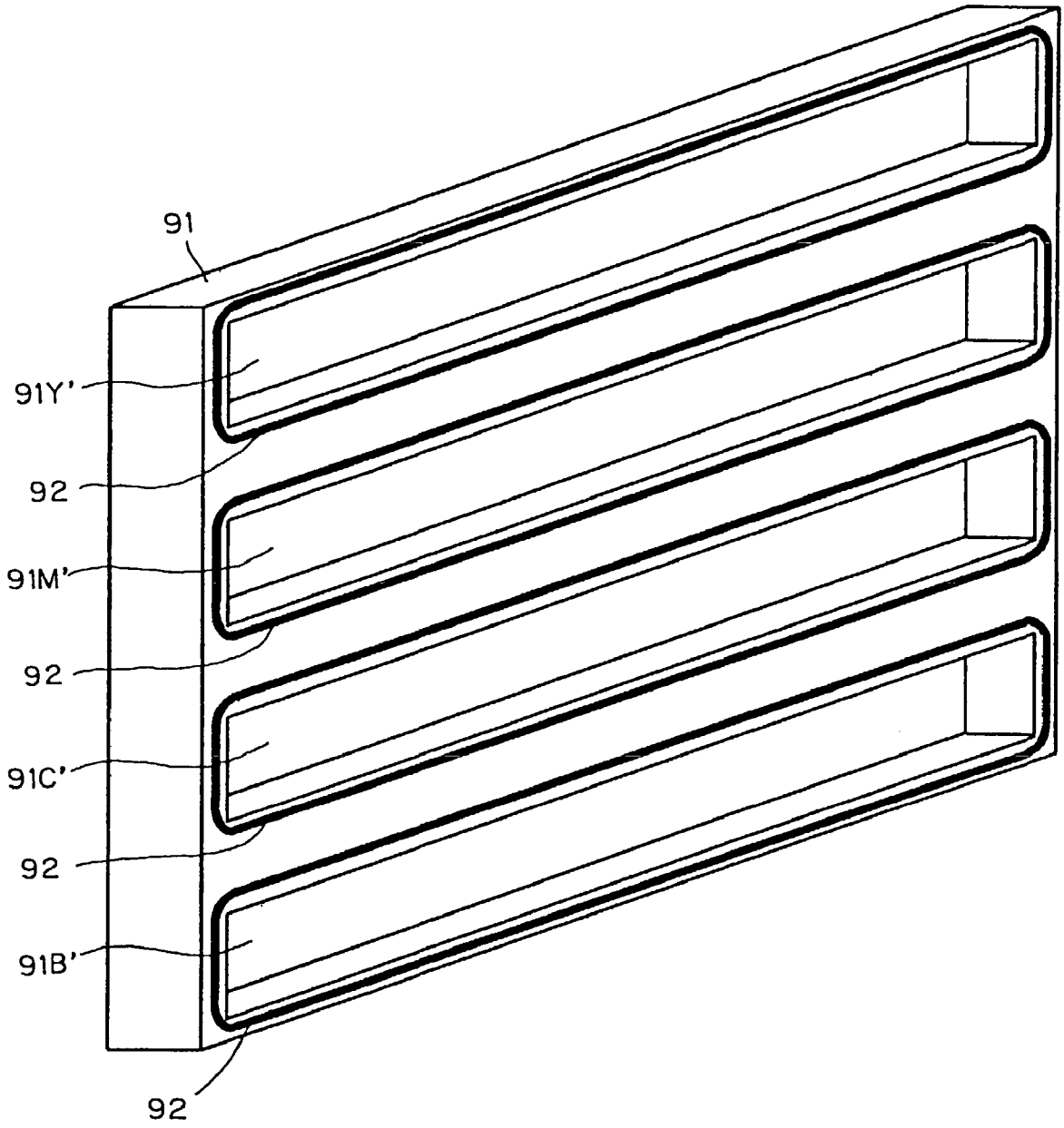
FIG. 28 is a perspective view showing a cap having a sealing member.

In FIGS. 23 through 27, the cap structure is provided independently for each color, so that the inks of different colors will not become mixed. In addition, FIG. 28 is a perspective view showing a cap having a sealing member. The cap 91 shown in FIG. 28 is the same as the cap 91 shown in FIG. 22, except that a sealing member 92 is provided with respect to each of the cap regions 91Y', 91M', 91C' and 91B'. The sealing member 92 is made of a resilient material, such as an O-ring, which is sufficiently compliant, by taking into consideration the squeeze when the sealing member 92 contacts the corresponding head block. The sealing member 92 may be made of a material such as fluoroplastics and silicone rubber which are corrosion resistant to the ink. The provision of the sealing member 92 positively prevents the inks of the different colors from mixing.

Figure 29:
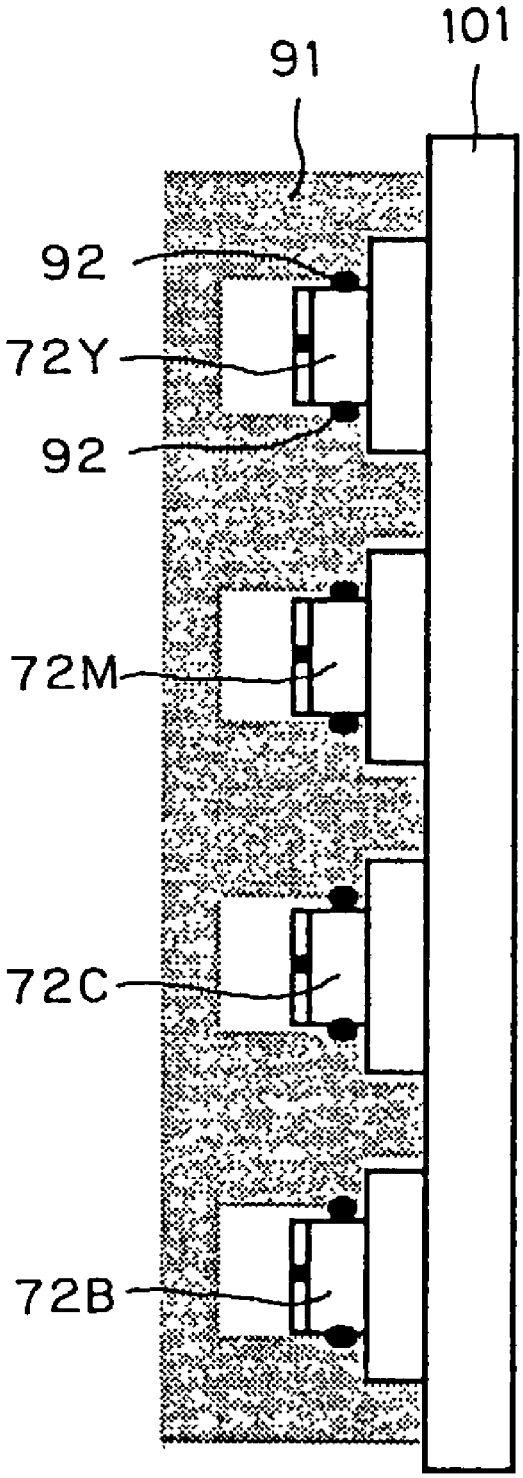
FIG. 29 is a diagram showing a cap formed to conform to a shape of a head block unit, together with the head block unit.
Figure 30:
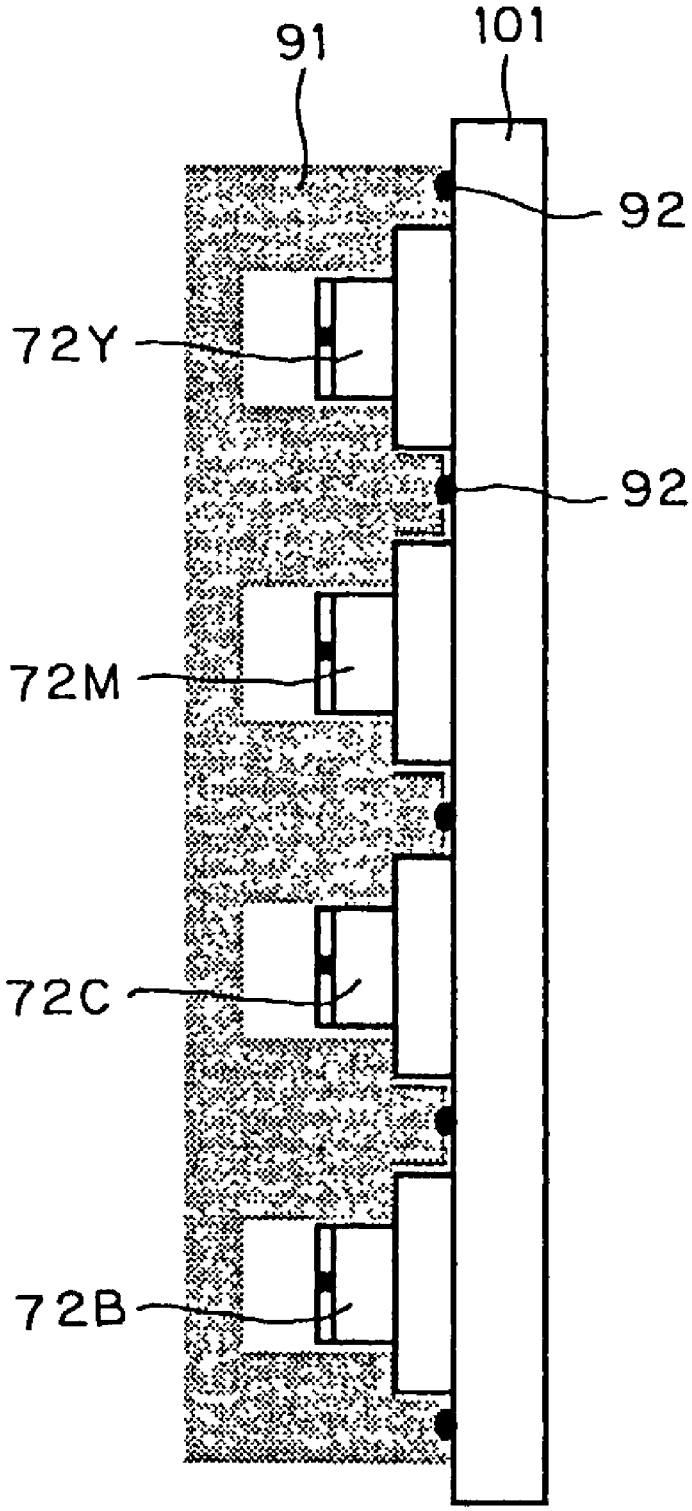
FIG. 30 is a diagram showing another cap formed to conform to the shape of the head block unit, together with the head block unit.

FIG. 29 is a diagram showing a cap formed to conform to a shape of a head block unit, together with the head block unit. In addition, FIG. 30 is a diagram showing another cap formed to conform to the shape of the head block unit, together with the head block unit. In FIGS. 29 and 30, those parts which are the same as those corresponding parts of the preceding figures are designated by the same reference numerals, and a description thereof will be omitted.

Because the cap 91 shown in FIG. 29 or 30 is shaped to conform to the shape of the head block unit, that is, the head blocks 72Y, 72M, 72C and 72B. As a result, it is possible to more positively and effectively seal each of the head blocks 72Y, 72N, 72C and 72B, and to extend the reliability of the apparatus.

Although the sealing member 92 is provided in the caps 91 shown in FIGS. 29 and 30, it is not essential to provide the sealing member 92. For example, in a case where the cap 91 is made of a resilient material and the cap 91 itself can also function as the sealing member 92, the portion of the cap 91 making contact with the corresponding head block functions as the sealing member 92 such as the O-ring.

Of course, the application of the ink-jet recording apparatus according to the present invention is not limited to the copying machine, and the ink-jet recording apparatus may similarly be applied to a facsimile machine, a composite machine which functions as at least two of the printer, copying machine and facsimile machine, and any other apparatus which has the recording function for recording information on a recording medium such as paper.

In each of the embodiments described heretofore, the reliability maintaining mechanism or the recovery unit operates during an arbitrary time when no ink-jet recording is made by the multi-nozzle ink-jet recording head, so as not to interfere with the recording operation.

Further, the present invention is not limited to these embodiments, but various variations and modifications may be made without departing from the scope of the present invention.

What is claimed is:

1. An ink-jet recording apparatus which records information within a recording width on a recording surface of a recording medium, comprising:

a recording section having a plurality of multi-nozzle ink-jet recording heads, each of said multi-nozzle ink-jet recording heads including a multi-nozzle array having a plurality of nozzles arranged in an array on the multi-nozzle ink-jet recording head to cover the recording width of the recording medium;

a transport section configured to transport the recording medium to pass a position confronting the multi-nozzle array of each of the multi-nozzle ink-jet recording heads of said recording section; and a reliability maintaining mechanism configured to cover all of the nozzles of the multi-nozzle array of each of the multi-nozzle ink-jet recording heads, so as to maintain reliability of the nozzles, wherein said multi-nozzle ink-jet recording heads correspond to respective different colors, and said reliability maintaining mechanism comprises a cap having a plurality of cap regions respectively corresponding to the respective different colors of the multi-nozzle ink-jet recording heads, each cap region of the plurality of cap regions corresponding to a respective one of the recording heads is an independent cap region, each of said cap regions covers the multi-nozzle array of a corresponding multi-nozzle ink-jet recording head for a length greater than a length of the multi-nozzle array of the corresponding multi-nozzle ink-jet recording head, and said cap extends in a longitudinal direction of the multi-nozzle array, so as to cover all of the nozzles of the multi-nozzle array of the corresponding multi-nozzle ink-jet recording head, each head is fully accommodated within the corresponding cap region of the cap, each of the cap regions and the corresponding multi-nozzle ink-jet recording head make contact via a resilient sealing member surrounding all of the nozzles of the multi-nozzle array of the corresponding multi-nozzle ink-jet recording head, and said resilient sealing member has dimensions which take into consideration a squeeze of approximately 10% to 50%, and the resilient sealing member is interposed between the cap and a support member supporting the multi-nozzle ink-jet recording heads, to seal each multi-nozzle ink-jet recording head by making contact with the cap and the support member, wherein each of said multi-nozzle ink-jet recording heads includes a surface approximately perpendicular to an ink-jet direction of the nozzles, said surface of the multi-nozzle ink-jet recording head is approximately perpendicular to a direction in which the cap moves relative to the multi-nozzle ink-jet recording head, and said resilient sealing member is disposed between said surface and said cap, and wherein for each of said multi-nozzle ink-jet recording heads said plurality of nozzles of said multi-nozzle array are arranged in a direction which is approximately perpendicular to a recording medium transport direction to cover the recording width of the recording medium, wherein said multi-nozzle ink-jet recording heads are arranged in the recording medium transport direction.

2. An ink-jet recording apparatus which records information within a recording width on a recording surface of a recording medium, comprising:

a recording section having a plurality of multi-nozzle ink-jet recording heads, each of said multi-nozzle ink-jet recording heads including a multi-nozzle array having a plurality of nozzles arranged in an array on the multi-nozzle ink-jet recording head to cover the recording width of the recording medium;

a transport section configured to transport the recording medium to pass a position confronting the multi-nozzle array of each of the multi-nozzle ink-jet recording heads of said recording section; and a reliability maintaining mechanism configured to cover all of the nozzles of the multi-nozzle array of each of the multi-nozzle ink-jet recording heads, so as to maintain reliability of the nozzles, wherein said multi-nozzle ink-jet recording heads correspond to respective different colors, and said reliability maintaining mechanism comprises a cap having a plurality of cap regions respectively corresponding to the respective different colors of the multi-nozzle ink-jet recording heads, each cap region of the plurality of cap regions corresponding to a respective one of the recording heads is an independent cap region, each of said cap regions covers the multi-nozzle array of a corresponding multi-nozzle ink-jet recording head for a length greater than a length of the multi-nozzle array of the corresponding multi-nozzle ink-jet recording head, and said cap extends in a longitudinal direction of the multi-nozzle array, so as to cover all of the nozzles of the multi-nozzle array of the corresponding multi-nozzle ink-jet recording head, each head is fully accommodated within the corresponding cap region of the cap, each of the cap regions and the corresponding multi-nozzle ink-jet recording head make contact via a resilient sealing member surrounding all of the nozzles of the multi-nozzle array of the corresponding multi-nozzle ink-jet recording head, and said resilient sealing member has dimensions which take into consideration a squeeze of approximately 10% to 50%, and the resilient sealing member is interposed between the cap and a support member supporting the multi-nozzle ink-jet recording heads, to seal each multi-nozzle ink-jet recording head by making contact with the cap and the support member, wherein each of said multi-nozzle ink-jet recording heads includes a surface approximately perpendicular to an ink-jet direction of the nozzles, said surface of the multi-nozzle ink-jet recording head is approximately perpendicular to a direction in which the cap moves relative to the multi-nozzle ink-jet recording head, and said resilient sealing member is disposed between said surface and said cap, and wherein for each of said multi-nozzle ink-jet recording heads said plurality of nozzles of said multi-nozzle array are arranged in a direction which is approximately perpendicular to a recording medium transport direction to cover the recording width of the recording medium, wherein each of said plurality of cap regions corresponding to said multi-nozzle ink-jet recording heads is sealed by a combination of the cap and the corresponding resilient sealing member.

3. An ink-jet recording apparatus which records information within a recording width on a recording surface of a recording medium, comprising:

a recording section having a plurality of multi-nozzle ink-jet recording heads, each of said multi-nozzle ink-jet recording heads including a multi-nozzle array having a plurality of nozzles arranged in an array on the multi-nozzle ink-jet recording head to cover the recording width of the recording medium;

a transport section configured to transport the recording medium to pass a position confronting the multi-nozzle array of each of the multi-nozzle ink-jet recording heads of said recording section;

a reliability maintaining mechanism configured to cover all of the nozzles of the multi-nozzle array of each of the multi-nozzle ink-jet recording heads, so as to maintain reliability of the nozzles; and a head block holding member, having a surface approximately perpendicularto an ink-jet direction of the nozzles, and configured to hold said multi-nozzle ink-jet recording heads on said surface, wherein said multi-nozzle ink-jet recording heads correspond to respective different colors, and said reliability maintaining mechanism comprises a cap having a plurality of cap regions respectively corresponding to the respective different colors of the multi-nozzle ink-jet recording heads, each cap region of the plurality of cap regions corresponding to a respective one of the recording heads is an independent cap region, each of said cap regions covers the multi-nozzle array of a corresponding multi-nozzle ink-jet recording head for a length greater than a length of the multi-nozzle array of the corresponding multi-nozzle ink-jet recording head, and said cap extends in a longitudinal direction of the multi-nozzle array, so as to cover all of the nozzles of the multi-nozzle array of the corresponding multi-nozzle ink-jet recording head, and each head is fully accommodated within the corresponding cap region of the cap, each of the cap regions and the corresponding multi-nozzle ink-jet recording head make contact via a resilient sealing member surrounding all of the nozzles of the multi-nozzle array of the corresponding multi-nozzle ink-jet recording head, and said resilient sealing member has dimensions which take into consideration a squeeze of approximately 10% to 50%, and the resilient sealing member is interposed between the cap and a support member supporting the multi-nozzle ink-jet recording heads, to seal each multi-nozzle ink-jet recording head by making contact with the cap and the support member, wherein said surface of the head block holding member is approximately perpendicular to a direction in which the cap moves relative to the multi-nozzle ink-jet recording head, wherein said resilient sealing member is disposed between said surface and said cap, wherein for each of said multi-nozzle ink-jet recording heads said plurality of nozzles of said multi-nozzle array are arranged in a direction which is approximately perpendicular to a recording medium transport direction to cover the recording width of the recording medium, and wherein said multi-nozzle ink-jet recording heads are arranged in the recording medium transport direction.

4. An ink-jet recording apparatus which records information within a recording width on a recording surface of a recording medium, comprising:

a recording section having a plurality of multi-nozzle ink-jet recording heads, each of said multi-nozzle ink-jet recording heads including a multi-nozzle array having a plurality of nozzles arranged in an array on the multi-nozzle ink-jet recording head to cover the recording width of the recording medium;

a transport section configured to transport the recording medium to pass a position confronting the multi-nozzle array of each of the multi-nozzle ink-jet recording heads of said recording section;

a reliability maintaining mechanism configured to cover all of the nozzles of the multi-nozzle array of each of the multi-nozzle ink-jet recording heads, so as to maintain reliability of the nozzles; and a head block holding member, having a surface approximately perpendicular to an ink-jet direction of the nozzles, and configured to hold said multi-nozzle ink-jet recording heads on said surface, wherein said multi-nozzle ink-jet recording heads correspond to respective different colors, and said reliability maintaining mechanism comprises a cap having a plurality of cap regions respectively corresponding to the respective different colors of the multi-nozzle ink-jet recording heads, each cap region of the plurality of cap regions corresponding to a respective one of the recording heads is an independent cap region, each of said cap regions covers the multi-nozzle array of a corresponding multi-nozzle ink-jet recording head for a length greater than a length of the multi-nozzle array of the corresponding multi-nozzle ink-jet recording head, and said cap extends in a longitudinal direction of the multi-nozzle array, so as to cover all of the nozzles of the multi-nozzle array of the corresponding multi-nozzle ink-jet recording head, and each head is fully accommodated within the corresponding cap region of the cap, each of the cap regions and the corresponding multi-nozzle ink-jet recording head make contact via a resilient sealing member surrounding all of the nozzles of the multi-nozzle array of the corresponding multi-nozzle ink-jet recording head, and said resilient sealing member has dimensions which take into consideration a squeeze of approximately 10% to 50% and the resilient sealing member is interposed between the cap and a support member supporting the multi-nozzle ink-jet recording heads, to seal each multi-nozzle ink-jet recording head by making contact with the cap and the support member, wherein said surface of the head block holding member is approximately perpendicular to a direction in which the cap moves relative to the multi-nozzle ink-jet recording head, wherein said resilient sealing member is disposed between said surface and said cap, wherein for each of said multi-nozzle ink-jet recording heads said plurality of nozzles of said multi-nozzle array are arranged in a direction which is approximately perpendicular to a recording medium transport direction to cover the recording width of the recording medium, and wherein each of said plurality of cap regions corresponding to said multi-nozzle ink-jet recording heads is sealed by a combination of the cap and the corresponding resilient sealing member.

* * * * *